US011763741B2

(12) United States Patent
Feng et al.

(10) Patent No.: US 11,763,741 B2
(45) **Date of Patent: *Sep. 19, 2023**

(54) GATE DRIVING UNIT, GATE DRIVING CIRCUIT, DISPLAY SUBSTRATE, DISPLAY PANEL AND DISPLAY DEVICE

(71) Applicants: HEFEI BOE JOINT TECHNOLOGY CO., LTD., Anhui (CN); BOE TECHNOLOGY GROUP CO., LTD., Beijing (CN)

(72) Inventors: Xuehuan Feng, Beijing (CN); Yongqian Li, Beijing (CN)

(73) Assignees: HEFEI BOE JOINT TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/820,415

(22) Filed: Aug. 17, 2022

(65) Prior Publication Data

US 2022/0398976 A1 Dec. 15, 2022

Related U.S. Application Data

(63) Continuation of application No. 16/956,921, filed as application No. PCT/CN2019/099783 on Aug. 8, 2019, now Pat. No. 11,482,168.

(51) Int. Cl.
*G09G 3/3225* (2016.01)
*G09G 3/3266* (2016.01)

(52) U.S. Cl.
CPC ..... *G09G 3/3225* (2013.01); *G09G 3/3266* (2013.01); *G09G 2310/0286* (2013.01)

(58) Field of Classification Search
None
See application file for complete search history.

(56) References Cited

U.S. PATENT DOCUMENTS

2006/0017686 A1 1/2006 Park
2006/0061562 A1* 3/2006 Park ..... G09G 3/3677 345/204

(Continued)

FOREIGN PATENT DOCUMENTS

CN 1728205 A 2/2006
CN 1928984 A 3/2007

(Continued)

OTHER PUBLICATIONS

International Search Report and Written Opinion for Application No. PCT/CN2019/099783, dated Apr. 24, 2020, 9 Pages.

(Continued)

*Primary Examiner* — Dorothy Harris
(74) *Attorney, Agent, or Firm* — BROOKS KUSHMAN P.C.

(57) ABSTRACT

A gate driving unit includes an Nth stage of shift register unit and an (N+1)th stage of shift register unit, N is a positive integer. The Nth stage of shift register unit includes an Nth stage of pull-up node control circuit, and the (N+1)th stage of shift register unit includes an (N+1)th stage of pull-up node control circuit. The Nth stage of pull-up node control circuit is electrically connected to an Nth stage of pull-up node and a control line, controls a potential of the Nth stage of pull-up node under the control of a control signal inputted by the control line. The (N+1)th stage of pull-up node control circuit is electrically connected to an (N+1)th stage of pull-up node and the control line, respectively, and (Continued)

controls a potential of the (N+1)th stage of pull-up node under the control of the control signal inputted by the control line.

16 Claims, 9 Drawing Sheets

(56) References Cited

U.S. PATENT DOCUMENTS

| | | | | |
|---|---|---|---|---|
| 2007/0290982 | A1 | 12/2007 | Kim et al. | |
| 2011/0273417 | A1 | 11/2011 | Shin et al. | |
| 2014/0055334 | A1* | 2/2014 | Qing | G11C 19/28 377/64 |
| 2014/0085176 | A1* | 3/2014 | Kang | G11C 19/28 377/77 |
| 2017/0221439 | A1* | 8/2017 | Chen | G11C 19/28 |
| 2018/0108426 | A1* | 4/2018 | Zheng | G09G 3/3677 |
| 2018/0252971 | A1 | 9/2018 | Irie et al. | |
| 2018/0335863 | A1 | 11/2018 | Hao | |
| 2018/0337682 | A1 | 11/2018 | Takasugi et al. | |
| 2021/0201774 | A1 | 7/2021 | Feng et al. | |
| 2021/0201805 | A1 | 7/2021 | Feng et al. | |
| 2021/0201807 | A1 | 7/2021 | Feng et al. | |
| 2021/0209987 | A1* | 7/2021 | Feng | G09G 3/20 |

FOREIGN PATENT DOCUMENTS

| | | | |
|---|---|---|---|
| CN | 101710481 | A | 5/2010 |
| CN | 102237031 | A | 11/2011 |
| CN | 106155420 | A | 11/2016 |
| CN | 107924662 | A | 4/2018 |
| CN | 108648714 | A | 10/2018 |
| CN | 108932930 | A | 12/2018 |
| CN | 109143696 | A | 1/2019 |
| CN | 109166527 | A | 1/2019 |
| CN | 109166529 | A | 1/2019 |
| CN | 109189255 | A | 1/2019 |
| CN | 109471562 | A | 3/2019 |
| CN | 109859701 | A | 6/2019 |
| CN | 109935187 | A | 6/2019 |
| CN | 109935188 | A | 6/2019 |
| CN | 109935204 | A | 6/2019 |
| KR | 20180072041 | A | 6/2018 |
| WO | 2017033341 | A1 | 3/2017 |

OTHER PUBLICATIONS

First Office Action for Chinese Application No. 201980001312.5, dated Apr. 8, 2022, 11 Pages.

Non-final Rejection for U.S. Appl. No. 16/956,921, dated Mar. 7, 2022, 19 Pages.

* cited by examiner

GATE DRIVING UNIT, GATE DRIVING CIRCUIT, DISPLAY SUBSTRATE, DISPLAY PANEL AND DISPLAY DEVICE

CROSS-REFERENCE TO RELATED APPLICATIONS

This application is a continuation application of U.S. application Ser. No. 16/956,921 filed Jun. 22, 2020, which is the U.S. national phase of PCT Application No. PCT/CN2019/099783 filed on Aug. 8, 2019, which are incorporated herein by reference in their entireties.

TECHNICAL FIELD

The present disclosure relates to the field of display driving technology, in particular to a gate driving unit, a gate driving circuit, a display substrate, a display panel and a display device.

BACKGROUND

In the related display field, a high-resolution 8 k active matrix organic light-emitting diode (AMOLED) display panel has more difficult processes and has limited pixel layout space. In the related display panel, the gate driving circuit includes a large number of signal lines, so the signal line crossover may occur, and the parasitic capacitance generated by the signal line crossover may increase, and high resolution cannot be achieved in a limited space.

SUMMARY

The present disclosure provides a gate driving unit, including an Nth stage of shift register unit and an (N+1)th stage of shift register unit, wherein N is a positive integer; the Nth stage of shift register unit comprises an Nth stage of pull-up node control circuit, and the (N+1)th stage of shift register unit comprises an (N+1)th stage of pull-up node control circuit; the Nth stage of pull-up node control circuit is electrically connected to an Nth stage of pull-up node and a control line, respectively, is configured to control a potential of the Nth stage of pull-up node under the control of a control signal inputted by the control line; and the (N+1)th stage of pull-up node control circuit is electrically connected to an (N+1)th stage of pull-up node and the control line, respectively, and is configured to control a potential of the (N+1)th stage of pull-up node under the control of the control signal inputted by the control line.

In some embodiments of the present disclosure, the control line comprises a first pull-up control line, a second pull-up control line, and a reset signal line; the Nth stage of pull-up node control circuit is configured to control a potential of the Nth stage of pull-up node under the control of a first pull-up control signal provided by the first pull-up control line, a second pull-up control signal provided by the second pull-up control line, and a reset signal provided by the reset signal line; and the (N+1)th stage of pull-up node control circuit is configured to control a potential of the (N+1)th stage of pull-up node under the control of the first pull-up control signal, the second pull-up control signal, and the reset signal.

In some embodiments of the present disclosure, the Nth stage of pull-up node control circuit comprises an Nth stage of first control circuit, an Nth stage of second control circuit, and an Nth stage of third control circuit; the Nth stage of first control circuit is electrically connected to the reset signal line, the Nth stage of control node, a first voltage terminal, and the Nth stage of pull-up node, respectively, and is configured to control the connection among the Nth stage of pull-up node, the Nth stage of control node and the first voltage terminal under the control of the reset signal provided by the reset signal line; the Nth stage of second control circuit is electrically connected to the first pull-up control line, the Nth stage of control node, the first voltage terminal and the Nth stage of pull-up node, respectively, is configured to control the connection among the Nth stage of pull-up node, the Nth stage of control node and the first voltage terminal under the control of the first pull-up control signal provided by the first pull-up control line; the Nth stage of third control circuit is electrically connected to the second pull-up control line, the Nth stage of control node and the Nth stage of pull-up node, respectively, and is configured to control the connection among the second pull-up control line, the Nth stage of control node, and the Nth stage of pull-up node under the control of the second pull-up control signal inputted by the second pull-up control line; the (N+1)th stage of pull-up node control circuit comprises an (N+1)th stage of first control circuit, an (N+1)th stage of second control circuit, and an (N+1)th stage of third control circuit, the (N+1)th stage of first control circuit is electrically connected to the reset signal line, an (N+1)th stage of control node, the first voltage terminal and an (N+1)th stage of pull-up node, respectively, is configured to control the connection among the (N+1)th stage of pull-up node, the (N+1)th stage of control node and the first voltage terminal under the control of the reset signal provided by the reset signal line; the (N+1)th stage of second control circuit is electrically connected to the first pull-up control line, the (N+1)th stage of control node, the first voltage terminal, and the (N+1)th stage of pull-up node, respectively, and is configured to control the connection among the (N+1)th stage of pull-up node, the (N+1)th stage of control node and the first voltage terminal under the control of the first pull-up control signal provided by the first pull-up control line; the (N+1)th stage of third control circuit is electrically connected to the second pull-up control line, the (N+1)th stage of control node and the (N+1)th stage of pull-up node, respectively, is configured to control the connection among the second pull-up control line, the (N+1)th stage of control node, and the (N+1)th stage of pull-up node under the control of the second pull-up control signal inputted by the second pull-up control line.

In some embodiments of the present disclosure, the first pull-up control line is electrically connected to an (N+8)th stage of the carry signal terminal, and the second pull-up control line is electrically connected to an (N−4)th stage of the carry signal terminal.

In some embodiments of the present disclosure, the Nth stage of first control circuit comprises a first control transistor and a second control transistor, a control electrode of the first control transistor is electrically connected to the reset signal line, a first electrode of the first control transistor is electrically connected to the Nth stage of pull-up node, and a second electrode of the first control transistor is electrically connected to the Nth stage of control node; a control electrode of the second control transistor is electrically connected to the reset signal line, a first electrode of the second control transistor is electrically connected to the Nth stage of control node, and a second electrode of the second control transistor is electrically connected to the first voltage terminal; the (N+1)th stage of first control circuit comprises a third control transistor and a fourth control transistor, a control electrode of the third control transistor is electrically connected to the reset signal line, a first electrode of the third control transistor is electrically connected to the (N+1)th stage of pull-up node, and a second electrode of the third control transistor is electrically connected to the (N+1)th stage of control node; a control electrode of the fourth control transistor is electrically connected to the reset signal line, a first electrode of the fourth control transistor is electrically connected to the (N+1)th stage of control node, and a second electrode of the fourth control transistor is electrically connected to the first voltage terminal.

In some embodiments of the present disclosure, the Nth stage of the second control circuit comprises a fifth control transistor and a sixth control transistor; a control electrode of the fifth control transistor is electrically connected to the first pull-up control line, a first electrode of the fifth control transistor is electrically connected to the Nth stage of pull-up node, and a second electrode of the fifth control transistor is electrically connected to the Nth stage of control node; a control electrode of the sixth control transistor is electrically connected to the first pull-up control line, a first electrode of the sixth control transistor is electrically connected to the Nth stage of control node, and the second electrode of the sixth control transistor is electrically connected to the first voltage terminal; the (N+1)th stage of second control circuit comprises a seventh control transistor and an eighth control transistor, a control electrode of the seventh control transistor is electrically connected to the first pull-up control line, a first electrode of the seventh control transistor is electrically connected to the (N+1)th stage of pull-up node, and a second electrode of the seventh control transistor is electrically connected to the (N+1)th stage of control node; and a control electrode of the eighth control transistor is electrically connected to the first pull-up control line, a first electrode of the eighth control transistor is electrically connected to the (N+1)th stage of control node, and a second electrode of the eighth control transistor is electrically connected to the first voltage terminal.

In some embodiments of the present disclosure, the Nth stage of the third control circuit comprises a ninth control transistor and a tenth control transistor; a control electrode of the ninth control transistor and a first electrode of the ninth control transistor are electrically connected to the second pull-up control line, and a second electrode of the ninth control transistor is electrically connected to the Nth stage of control node; a control electrode of the tenth control transistor is electrically connected to the second pull-up control line, a first electrode of the tenth control transistor is electrically connected to the Nth stage of control node, and a second electrode of the tenth control transistor is electrically connected to the Nth stage of pull-up node; the (N+1)th stage of third control circuit comprises an eleventh control transistor and a twelfth control transistor; a control electrode of the eleventh control transistor and a first electrode of the eleventh control transistor are electrically connected to the second pull-up control line, and a second electrode of the eleventh control transistor is electrically connected to the (N+1)th stage of control node; and a control electrode of the twelfth control transistor is electrically connected to the second pull-up control line, a first electrode of the twelfth control transistor is electrically connected to the (N+1)th stage of control node, and the second electrode of the tenth control transistor is electrically connected to the (N+1)th stage of pull-up node.

In some embodiments of the present disclosure, the Nth stage of pull-up node control circuit further comprises an Nth stage of pull-up control node control circuit, an Nth stage of fourth control circuit, and an Nth stage of fifth control circuit, the Nth stage of pull-up control node control circuit is respectively connected to an enable terminal, a second pull-up control line, the first node, the first voltage terminal, a second voltage terminal, a first clock signal terminal and the Nth stage of pull-up control node, is configured to control the potential of the first node under the control of an enable signal provided by the enable terminal, based on the potential of the second pull-up control line, the first voltage and the second voltage, and is configured to control the connection between the Nth stage of pull-up control node and the first clock signal terminal under the control of the potential of the first node; the Nth stage of fourth control circuit is electrically connected to the first clock signal terminal, the Nth stage of pull-up control node, the Nth stage of control node and the second voltage terminal, respectively, and is configured to control the connection between the Nth stage of pull-up control node and the Nth stage of control node and the connection between the Nth stage of control node and the Nth stage of pull-up node under the control of a first clock signal, and control the connection between the Nth stage of control node and the second voltage terminal under the control the potential of the Nth stage of the pull-up node; the Nth stage of fifth control circuit is electrically connected to the first pull-down node, the second pull-down node, the Nth stage of pull-up node, the Nth stage of control node and the first voltage terminal, respectively, and is configured to control the connection between the Nth stage of pull-up node and the Nth stage of control node and the connection between the Nth stage of control node and the first voltage terminal under the control of the potential of the pull node, and is configured to control the connection between the Nth stage of pull-up node and the Nth stage of control node and the connection between the Nth stage of control node and the first voltage terminal under the control of the potential of the second pull-down node.

In some embodiments of the present disclosure, the Nth stage of pull-up control node control circuit comprises: a first transistor, a control electrode thereof being electrically connected to the enable terminal, and a first electrode thereof being electrically connected to the second pull-up control line; a second transistor, a control electrode thereof being electrically connected to the enable terminal, a first electrode thereof being electrically connected to the second electrode of the first transistor, and a second electrode thereof being electrically connected to the first voltage terminal; a third transistor, a control electrode thereof being electrically connected to the first node, a first electrode thereof being electrically connected to the second electrode of the first transistor, and a second electrode thereof being electrically connected to the second voltage terminal; a first capacitor, a first end thereof being electrically connected to the first node, and a second end thereof being electrically connected to the first voltage terminal; and a fourth transistor, a control electrode thereof being electrically connected to the first node, a first electrode thereof being electrically connected to the first clock signal terminal, and a second electrode thereof being electrically connected to the Nth stage of pull-up control node.

In some embodiments of the present disclosure, the Nth stage of fourth control circuit comprises a fifth transistor, a sixth transistor, and a tenth transistor, a control electrode of the fifth transistor is electrically connected to the first clock signal terminal, a first electrode of the fifth transistor is electrically connected to the Nth stage of pull-up control node, and a second electrode of the fifth transistor is electrically connected to the Nth stage of control node; a control electrode of the sixth transistor is electrically connected to the first clock signal terminal, a first electrode of the sixth transistor is electrically connected to the Nth stage of control node, and a second electrode of the sixth transistor is electrically connected to the Nth stage of pull-up node connection; and a control electrode of the tenth transistor is electrically connected to the Nth stage of pull-up node, a first electrode of the tenth transistor is electrically connected to the Nth stage of control node, and a second electrode of the tenth transistor is electrically connected to the second voltage terminal.

In some embodiments of the present disclosure, the Nth stage of fifth control circuit comprises: a thirteenth transistor, a control electrode thereof being electrically connected to the first pull-down node, a first electrode thereof being electrically connected to the Nth stage of pull-up node, and a second electrode thereof being electrically connected to the Nth stage of control node; a fourteenth transistor, a control electrode thereof being electrically connected to the first pull-down node, a first electrode thereof being electrically connected to the Nth stage of control node, and a second electrode thereof being is electrically connected to the first voltage terminal; a fifteenth transistor, a control electrode thereof being electrically connected to the second pull-down node, a first electrode thereof being electrically connected to the Nth stage of pull-up node, and a second electrode thereof being is electrically connected to the Nth stage of control node; and a sixteenth transistor, a control electrode thereof being is electrically connected to the second pull-down node, a first electrode thereof being electrically connected to the Nth stage of control node, and a second electrode thereof being is electrically connected to the first voltage terminal.

In some embodiments of the present disclosure, the (N+1)th stage of pull-up node control circuit further comprises an (N+1)th stage of fourth control circuit and an (N+1)th stage of fifth control circuit; the (N+1)th stage of fourth control circuit is connected to the first clock signal terminal, the Nth stage of pull-up control node, the (N+1)th stage of control node and the second voltage terminal, under the control of the first clock signal, controls the connection between the Nth stage of pull-up control node and the (N+1)th stage of control node, and the connection between the (N+1)th stage of control node and the (N+1)th stage of pull-up node, and under the control of the potential of (N+1)th stage of pull-up node, controls the connection between the (N+1)th stage of control node and the second voltage terminal; and the (N+1)th stage of fifth control circuit is respectively connected to the first pull-down node, the second pull-down node, the (N+1)th stage of pull-up node, and the (N+1)th stage of control node and the first voltage terminal, and the under the control of the potential of the first pull-down node, controls the connection between the (N+1)th stage of pull-up node and the (N+1)th stage of control node, and controls the connection between the (N+1)th stage of control node and the first voltage terminal, and under the control of the potential of the second pull-down node, controls the connection between the (N+1)th stage of pull-up node and the (N+1)th stage of control node, and the connection between the (N+1)th stage of control node and the first voltage terminal.

In some embodiments of the present disclosure, the (N+1)th stage of fourth control circuit comprises a thirty third transistor, a thirty fourth transistor, and a thirty eighth transistor; a control electrode of the thirty third transistor is electrically connected to the first clock signal terminal, a first electrode of the thirty third transistor is electrically connected to the Nth stage of pull-up control node, and a second electrode of the thirty third transistor is electrically connected to the (N+1)th stage of control node; a control electrode of the thirty fourth transistor is electrically connected to the first clock signal terminal, a first electrode of the thirty fourth transistor is electrically connected to the (N+1)th stage of control node, and a second electrode of the thirty fourth transistor is electrically connected to the (N+1)th stage of pull-up node; and a control electrode of the thirty eighth transistor is electrically connected to the (N+1)th stage of pull-up node, a first electrode of the thirty eighth transistor is electrically connected to the (N+1)th stage of control node, and a second electrode of the thirty eighth transistor is electrically connected to the second voltage terminal.

In some embodiments of the present disclosure, the (N+1)th stage of fifth control circuit comprises: a forty first transistor, a control electrode thereof being electrically connected to the first pull-down node, a first electrode thereof being electrically connected to the (N+1)th stage of pull-up node, and a second electrode thereof being electrically connected to the (N+1)th stage of control node; a forty second transistor, a control electrode thereof being electrically connected to the first pull-down node, a first electrode thereof being electrically connected to the (N+1)th stage of control node, and a second electrode thereof being electrically connected to the first voltage terminal; a forty third transistor, a control electrode thereof being electrically connected to the second pull-down node, a first electrode thereof being electrically connected to the (N+1)th stage of pull-up node, and a second electrode thereof being electrically connected to the (N+1)th stage of control node; and a forty fourth transistor, a control electrode thereof being electrically connected to the second pull-down node, a first electrode thereof being electrically connected to the (N+1)th stage of control node, and a second electrode thereof being is electrically connected to the first voltage terminal.

In a second aspect, a gate driving circuit includes a plurality of gate driving units.

In a third aspect, a display substrate includes a base substrate and the gate driving circuit arranged on the base substrate.

In some embodiments of the present disclosure, there is an X axis parallel to a gate line between the Nth stage of shift register unit included in the gate driving unit and the (N+1)th stage of shift register unit included in the gate driving unit; the Nth stage of pull-up node control circuit comprises an Nth stage of first control circuit, an Nth stage of second control circuit, and an Nth stage of third control circuit, and the (N+1)th stage of pull-up node control circuit comprises an (N+1)th stage of first control circuit, an (N+1)th stage of second control circuit and an (N+1)th stage of third control circuit; the Nth stage of first control circuit comprises a first control transistor and a second control transistor, the (N+1)th stage of first control circuit comprises a third control transistor and a fourth control transistor; the Nth stage of second control circuit comprises a fifth control transistor and a sixth control transistor, the (N+1)th stage of second control circuit comprises a seventh control transistor and an eighth control transistor; the Nth stage of third control circuit comprises a ninth control transistor and a tenth control transistor, the (N+1)th stage of third control circuit comprises an eleventh control transistor and a twelfth control transistor; the first control transistor and the third control transistor are arranged symmetrically on both sides of the X axis; the second control transistor and the fourth control transistor are arranged symmetrically on both sides of the X axis; the fifth control transistor and the seventh control transistor are arranged symmetrically on both sides of the X axis; the sixth control transistor and the eighth control transistor are symmetrically arranged on both sides of the X axis; the ninth control transistor and the eleventh control transistor are symmetrically arranged on both sides of the X axis; and the tenth control transistor and the twelfth control transistor are symmetrically arranged on both sides of the X axis.

In some embodiments of the present disclosure, there is an X axis parallel to the gate line between of the Nth stage of shift register unit included in the gate driving unit and the (N+1)th stage of shift register unit included in the gate driving unit; the Nth stage of pull-up node control circuit comprises an Nth stage of pull-up control node control circuit, an Nth stage of fourth control circuit, and an Nth stage of fifth control circuit; the (N+1)th stage of pull-up node control circuit comprises (N+1)th stage of fourth control circuit and (N+1)th stage of fifth control circuit; the Nth stage of fifth control circuit comprises a thirteenth transistor, a fourteenth transistor, a fifteenth transistor, and a sixteenth transistor, and the (N+1)th stage of fifth control circuit comprises a forty first transistor, a forty second transistor, a forty third transistor and a forty fourth transistor; the thirteenth transistor and the forty third transistor are symmetrically arranged on both sides of the X axis, the fourteenth transistor and the forty fourth transistor are symmetrically arranged on both sides of the X axis, and the fifteenth transistor and the forty first transistor are symmetrically arranged on both sides of the X axis, and the sixteenth transistor and the forty second transistor are symmetrically arranged on both sides of the X axis.

In a fourth aspect, a display panel includes the above display substrate.

In a fifth aspect, a display device includes the above display panel.

DETAILED DESCRIPTION

Figure 1:
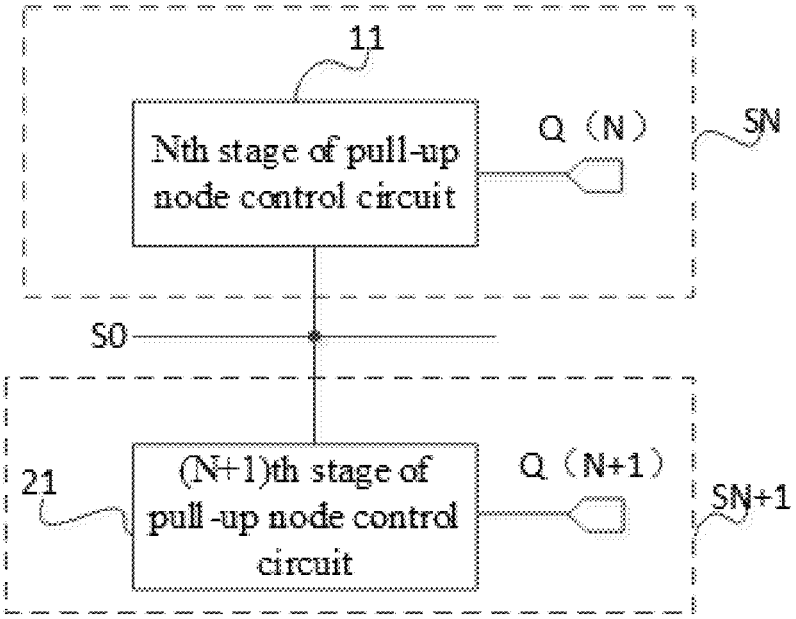
FIG. 1 is a structural diagram of a gate driving unit according to at least one embodiment of the present disclosure.

The technical solutions in the embodiments of the present disclosure will be described clearly and completely with reference to the drawings in the embodiments of the present disclosure, and it is obvious that the embodiments described are only some embodiments of the present disclosure, rather than all embodiments. All other embodiments, which can be derived by a person skilled in the art from the embodiments disclosed herein without making any creative effort, shall fall within the protection scope of the present disclosure.

The transistors used in all embodiments of the present disclosure may be transistors, thin film transistors, or field effect transistors or other devices with the same characteristics. In the embodiments of the present disclosure, to distinguish two electrodes of a transistor except for a control electrode, one electrode is referred to as a first electrode, and the other electrode is referred to as a second electrode.

In practical operation, for a transistor, the control electrode may be a base electrode, the first electrode may be a collector electrode, and the second electrode may be an emitter electrode. Alternatively, the control electrode may be a base electrode, the first electrode may be an emitter electrode, and the second electrode may be a collector electrode.

In practical operation, when the transistor is a thin film transistor or a field effect transistor, the control electrode may be a gate electrode, the first electrode may be a drain electrode, and the second electrode may be a source electrode. Alternatively, the control electrode may be a gate electrode, the first electrode may be a source electrode, and the second electrode may be a drain electrode.

The gate driving unit according to at least one embodiment of the present disclosure includes an Nth stage of shift register unit and an (N+1)th stage of shift register unit, where N is a positive integer.

The Nth stage of shift register unit includes an Nth stage of pull-up node control circuit, and the (N+1)th stage of shift register unit includes an (N+1)th stage of pull-up node control circuit.

The Nth stage of pull-up node control circuit is electrically connected to the Nth stage of pull-up node and a control line, respectively, is used to control a potential of the Nth stage of pull-up node under the control of a control signal inputted by the control line.

The (N+1)th stage of pull-up node control circuit is electrically connected to the (N+1)th stage of pull-up node and the control line, respectively, and is used to control the potential of the (N+1)th stage of pull-up node under the control of the control signal inputted by the control line.

The gate driving unit according to at least one embodiment of the present disclosure includes two stages of shift register units, and the two stages of shift register units share the control line, so the two stages of shift register units only need to provide one set of control lines, which reduces the number of signal lines and reduces the parasitic capacitance generated across the signal lines, and can achieve high resolution in a limited space.

As shown in FIG. 1, the gate driving unit according to at least one embodiment of the present disclosure includes an Nth stage of shift register unit SN and an (N+1)th stage of shift register unit SN+1, where N is a positive integer.

The Nth stage of shift register unit SN includes an Nth stage of pull-up node control circuit 11, and the (N+1)th stage of shift register unit SN+1 includes an (N+1)th stage of pull-up node control circuit 21.

The Nth stage of pull-up node control circuit 11 is electrically connected to the Nth stage of pull-up node Q(N) and the control line S0, respectively, and is used to control the potential of the Nth stage of pull-up node Q(N) under the control of the control signal inputted by the control line S0.

The (N+1)th stage of pull-up node control circuit 21 is electrically connected to the (N+1)th stage of pull-up node Q(N+1) and the control line S0, respectively, is used to control the potential of (N+1)th stage of pull-up node Q(N) under the control of the control signal inputted by the control line S0.

In the gate driving unit described in at least one embodiment of the present disclosure shown in FIG. 1, the Nth stage of pull-up node control circuit 11 and the (N+1)th stage of pull-up node control circuit 21 share the control line S0, thereby reducing the number of signal lines.

Specifically, the control line may include a first pull-up control line, a second pull-up control line, and a reset signal line.

The Nth stage of pull-up node control circuit is used to control the potential of the Nth stage of pull-up node under the control of a first pull-up control signal provided by the first pull-up control line, a second pull-up control signal provided by the second pull-up control line, and the reset signal provided by the reset signal line.

The (N+1)th stage of pull-up node control circuit is used to control the potential of the (N+1)th stage of pull-up node under the control of the first pull-up control signal, the second pull-up control signal, and the reset signal.

Figure 2:
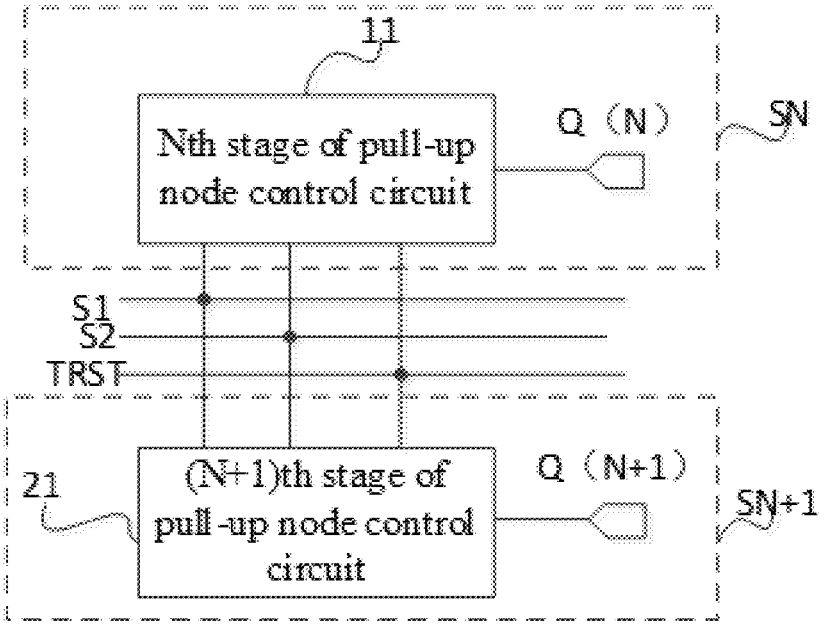
FIG. 2 is another structural diagram of a gate driving unit according to at least one embodiment of the present disclosure.

As shown in FIG. 2, on the basis of the gate driving unit shown in FIG. 1 according to at least one embodiment of the present disclosure, the control line S0 includes a first pull-up control line S1, a second pull-up control line S2 and a reset signal line TRST.

The Nth stage of pull-up node control circuit 11 is electrically connected to the first pull-up control line S1, the second pull-up control line S2 and the reset signal line TRST, respectively, and is used to control the potential of Nth stage of pull-up node Q(N) under the control of the first pull-up control signal provided by the first pull-up control line S1, the second pull-up control signal provided by the second pull-up control line S2, and the reset signal provided by the reset signal line TRST.

The (N+1)th stage of pull-up node control circuit 21 is electrically connected to the first pull-up control line S1, the second pull-up control line S2, and the reset signal line TRST, respectively, and is used to control the potential of the (N+1)th stage of pull-up node Q(N+1) under the control of the first pull-up control signal, the second pull-up control signal and the reset signal.

Optionally, the Nth stage of pull-up node control circuit may include an Nth stage of first control circuit, an Nth stage of second control circuit, and an Nth stage of third control circuit.

The Nth stage of first control circuit is electrically connected to the reset signal line, the Nth stage of control node, the first voltage terminal, and the Nth stage of pull-up node, respectively, and is used to control the connection among the Nth stage of pull-up node, the Nth stage of control node and the first voltage terminal under the control of the reset signal provided by the reset signal line.

The Nth stage of second control circuit is electrically connected to the first pull-up control line, the Nth stage of control node, the first voltage terminal and the Nth stage of pull-up node, respectively, is used to control the connection among the Nth stage of pull-up node, the Nth stage of control node and the first voltage terminal under the control of the first pull-up control signal provided by the first pull-up control line.

The Nth stage of third control circuit is electrically connected to the second pull-up control line, the Nth stage of control node and the Nth stage of pull-up node, respectively, and is used to control the connection among the second pull-up control line, the Nth stage of control node, and the Nth stage of pull-up node under the control of the second pull-up control signal inputted by the second pull-up control line.

The (N+1)th stage of pull-up node control circuit includes an (N+1)th stage of first control circuit, an (N+1)th stage of second control circuit, and an (N+1)th stage of third control circuit.

The (N+1)th stage of first control circuit is electrically connected to the reset signal line, the (N+1)th stage of control node, the first voltage terminal and the (N+1)th stage of pull-up node, respectively, is used to control the connection among the (N+1)th stage of pull-up node, the (N+1)th stage of control node and the first voltage terminal under the control of the reset signal provided by the reset signal line.

The (N+1)th stage of second control circuit is electrically connected to the first pull-up control line, the (N+1)th stage of control node, the first voltage terminal, and the (N+1)th stage of pull-up node, respectively, and is used to control the connection among the (N+1)th stage of pull-up node, the (N+1)th stage of control node and the first voltage terminal under the control of the first pull-up control signal provided by the first pull-up control line.

The (N+1)th stage of third control circuit is electrically connected to the second pull-up control line, the (N+1)th stage of control node and the (N+1)th stage of pull-up node, respectively, is used to control the connection among the second pull-up control line, the (N+1)th stage of control node, and the (N+1)th stage of pull-up node under the control of the second pull-up control signal inputted by the second pull-up control line.

Figure 3:
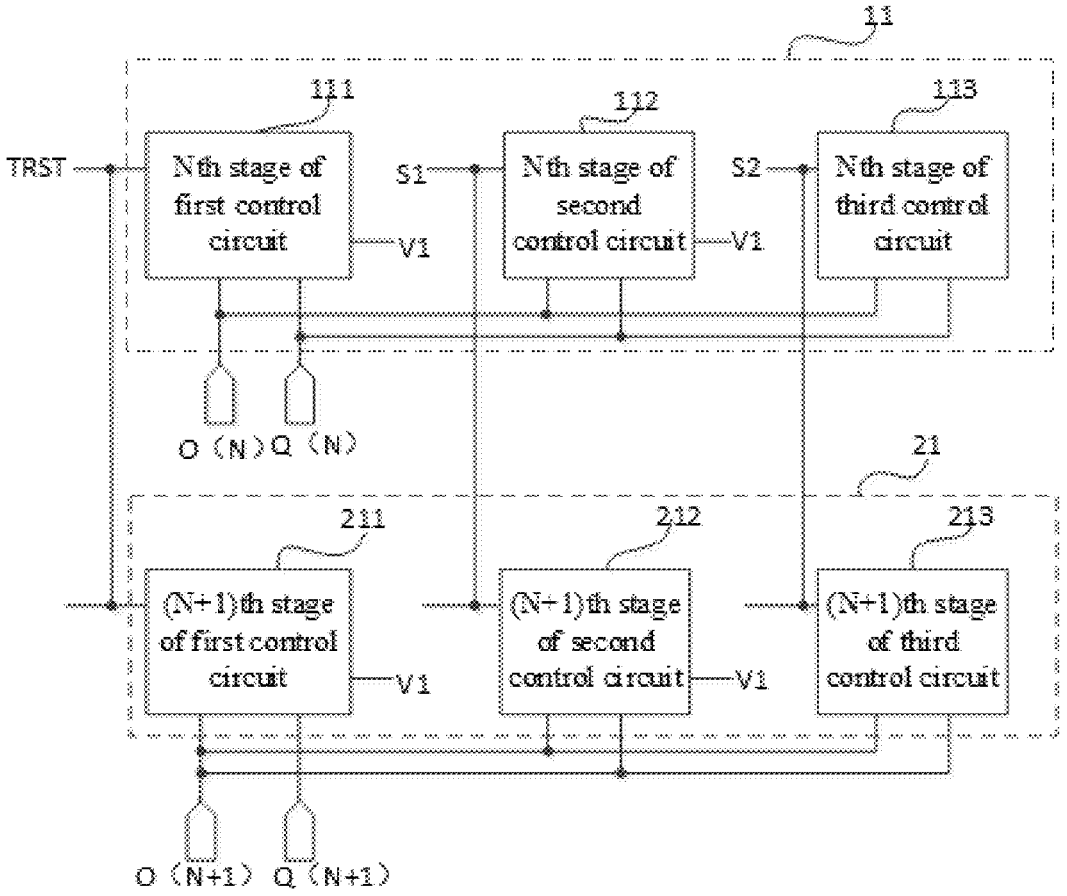
FIG. 3 is yet another structural diagram of a gate driving unit according to at least one embodiment of the present disclosure.

In a specific implementation, as shown in FIG. 3, on the basis of the gate driving unit shown in FIG. 2 according to at least one embodiment of the present disclosure, the Nth stage of pull-up node control circuit 11 may include an Nth stage of first control circuit 111, an N stage of second control circuit 112, and an N stage of third control circuit 113.

The Nth stage of first control circuit 111 is electrically connected to the reset signal line TRST, the Nth stage of control node O(N), the first voltage terminal, and the Nth stage of pull-up node Q(N), respectively, and is used to control the connection among the Nth stage of pull-up node Q(N), the Nth stage of control node O(N) and the first voltage terminal under the control of the reset signal provided by the reset signal line TRST, the first voltage terminal is configured to provide a first voltage V1.

The Nth stage of second control circuit 112 is electrically connected to the first pull-up control line S1, the Nth stage of control node O(N), the first voltage terminal and the Nth stage of pull-up node Q(N), and is used to control the connection among the Nth stage of pull-up node Q(N), the Nth stage of control node O(N) and the first voltage terminal under the control of the first pull-up control signal provided by the first pull-up control line S1.

The Nth stage of third control circuit 113 is electrically connected to the second pull-up control line S2, the Nth stage of control node O(N) and the Nth stage of pull-up node Q(N), respectively, and is used to control the connection among the second pull-up control line S2, the Nth stage of control node O(N), and the Nth stage of pull-up nodes Q(N) under the control of the second pull-up control signal inputted by the second pull-up control line S2.

The (N+1)th stage of pull-up node control circuit 21 includes an (N+1)th stage of first control circuit 211, an (N+1)th stage of second control circuit 212, and an (N+1)th stage of third control circuit 213.

The (N+1)th stage of first control circuit 211 is connected to the reset signal line TRST, the (N+1)th stage of control node O(N+1), the first voltage terminal, and the (N+1)th stage of pull-up node Q(N+1), respectively, and is used to control the connection among the (N+1)th stage of pull-up node Q(N+1), the (N+1)th stage of control node O(N+1) and the first voltage terminal under the control of the reset signal provided by the reset signal line TRST.

The (N+1)th second control circuit 212 is connected to the first pull-up control line S1, the (N+1)th control node O(N+1), the first voltage terminal, and the (N+1) th stage of pull-up node Q(N+1), and is used to control the connection among the (N+1)th stage of pull-up node Q(N+1), the (N+1)th stage of control node O(N+1) and the first voltage terminal under the control of the first pull-up control signal provided by the first pull-up control line S1.

The (N+1)th stage of third control circuit 213 is connected to the second pull-up control line S2, the (N+1)th stage of control node O(N+1) and the (N+1)th stage of pull-up node Q(N+), and is used to control the connection among the second pull-up control line S2, the (N+1)th stage of control node O(N+1), and the (N+1)th stage of pull-up node Q(N+1) under the control of the second pull-up control signal inputted by the second pull-up control line S2 (N+1).

In the gate driving unit described in at least one embodiment of the present disclosure, the first voltage V1 may be the first low voltage VGL1, but it is not limited thereto.

Optionally, the first pull-up control line may be electrically connected to the (N+8)th stage of the carry signal terminal, and the second pull-up control line may be electrically connected to the (N−4)th stage of the carry signal terminal.

Optionally, the Nth stage of first control circuit may include a first control transistor and a second control transistor. A control electrode of the first control transistor is electrically connected to the reset signal line, a first electrode of the first control transistor is electrically connected to the Nth stage of pull-up node, and a second electrode of the first control transistor is electrically connected to the Nth stage of control node. A control electrode of the second control transistor is electrically connected to the reset signal line, a first electrode of the second control transistor is electrically connected to the Nth stage of control node, and a second electrode of the second control transistor is electrically connected to the first voltage terminal.

The (N+1)th stage of first control circuit includes a third control transistor and a fourth control transistor. A control electrode of the third control transistor is electrically connected to the reset signal line, a first electrode of the third control transistor is electrically connected to the (N+1)th stage of pull-up node, and a second electrode of the third control transistor is electrically connected to the (N+1)th stage of control node. A control electrode of the fourth control transistor is electrically connected to the reset signal line, a first electrode of the fourth control transistor is electrically connected to the (N+1)th stage of control node, and a second electrode of the fourth control transistor is electrically connected to the first voltage terminal.

Optionally, the Nth stage of the second control circuit may include a fifth control transistor and a sixth control transistor. A control electrode of the fifth control transistor is electrically connected to the first pull-up control line, a first electrode of the fifth control transistor is electrically connected to the Nth stage of pull-up node, and a second electrode of the fifth control transistor is electrically connected to the Nth stage of control node. A control electrode of the sixth control transistor is electrically connected to the first pull-up control line, a first electrode of the sixth control transistor is electrically connected to the Nth stage of control node, and the second electrode of the sixth control transistor is electrically connected to the first voltage terminal.

The (N+1)th stage of second control circuit includes a seventh control transistor and an eighth control transistor. A control electrode of the seventh control transistor is electrically connected to the first pull-up control line, a first electrode of the seventh control transistor is electrically connected to the (N+1)th stage of pull-up node, and a second electrode of the seventh control transistor is electrically connected to the (N+1)th stage of control node. A control electrode of the eighth control transistor is electrically connected to the first pull-up control line, a first electrode of the eighth control transistor is electrically connected to the (N+1)th stage of control node, and a second electrode of the eighth control transistor is electrically connected to the first voltage terminal.

Optionally, the Nth stage of the third control circuit may include a ninth control transistor and a tenth control transistor. A control electrode of the ninth control transistor and a first electrode of the ninth control transistor are electrically connected to the second pull-up control line, and a second electrode of the ninth control transistor is electrically connected to the Nth stage of control node. A control electrode of the tenth control transistor is electrically connected to the second pull-up control line, a first electrode of the tenth control transistor is electrically connected to the Nth stage of control node, and a second electrode of the tenth control transistor is electrically connected to the Nth stage of pull-up node.

The (N+1)th stage of third control circuit includes an eleventh control transistor and a twelfth control transistor. A control electrode of the eleventh control transistor and a first electrode of the eleventh control transistor are electrically connected to the second pull-up control line, and a second electrode of the eleventh control transistor is electrically connected to the (N+1)th stage of control node. A control electrode of the twelfth control transistor is electrically connected to the second pull-up control line, a first electrode of the twelfth control transistor is electrically connected to the (N+1)th stage of control node, and the second electrode of the tenth control transistor is electrically connected to the (N+1)th stage of pull-up node.

Optionally, the Nth stage of pull-up node control circuit may further include an Nth stage of pull-up control node control circuit, an Nth stage of fourth control circuit, and an Nth stage of fifth control circuit.

The Nth stage of pull-up control node control circuit is respectively connected to an enable terminal, a second pull-up control line, the first node, the first voltage terminal, a second voltage terminal, a first clock signal terminal and the Nth stage of pull-up control node, is used to control the potential of the first node under the control of the enable signal provided by the enable terminal, based on the potential of the second pull-up control line, the first voltage and the second voltage, and is used to control the connection between the Nth stage of pull-up control node and the first clock signal terminal under the control of the potential of the first node.

The Nth stage of fourth control circuit is electrically connected to the first clock signal terminal, the Nth stage of pull-up control node, the Nth stage of control node and the second voltage terminal, respectively, and is used to control the connection between the Nth stage of pull-up control node and the Nth stage of control node and the connection between the Nth stage of control node and the Nth stage of pull-up node under the control of the first clock signal, and control the connection between the Nth stage of control node and the second voltage terminal under the control the potential of the Nth stage of the pull-up node.

The Nth stage of fifth control circuit is electrically connected to the first pull-down node, the second pull-down node, the Nth stage of pull-up node, the Nth stage of control node and the first voltage terminal, respectively, and is used to control the connection between the Nth stage of pull-up node and the Nth stage of control node and the connection between the Nth stage of control node and the first voltage terminal under the control of the potential of the pull node, and is used to control the connection between the Nth stage of pull-up node and the Nth stage of control node and the connection between the Nth stage of control node and the first voltage terminal under the control of the potential of the second pull-down node.

Optionally, the (N+1)th stage of pull-up node control circuit may further include an (N+1)th stage of fourth control circuit and an (N+1)th stage of fifth control circuit.

The (N+1)th stage of fourth control circuit is electrically connected to the first clock signal terminal, the Nth stage of pull-up control node, the (N+1)th stage of control node and the second voltage terminal, respectively, and is used to control the connection between the Nth stage of pull-up control node and the (N+1)th stage of control node, and the connection between the (N+1)th stage of control node and the (N+1)th stage of pull-up node under the control of the first clock signal, and is used to control the connection between the (N+1)th stage of control node and the second voltage terminal under the control of the potential of the (N+1)th stage of pull-up node.

The (N+1)th stage of fifth control circuit is electrically connected to a first pull-down node, a second pull-down node, the (N+1)th stage of pull-up node, the (N+1)th stage of control node and the first voltage terminal, respectively, and under the control of the potential of the first pull-down node, controls the connection between the (N+1)th stage of pull-up node and the (N+1)th stage of control node, and controls the (N+1)th stage of control node and the first voltage terminal, and under the control of the potential of the second pull-down node, controls the connection between the (N+1)th stage of pull-up node and the (N+1)th stage of control node and control the connection between the (N+1) th stage of control node and the first voltage terminal.

Figure 4:
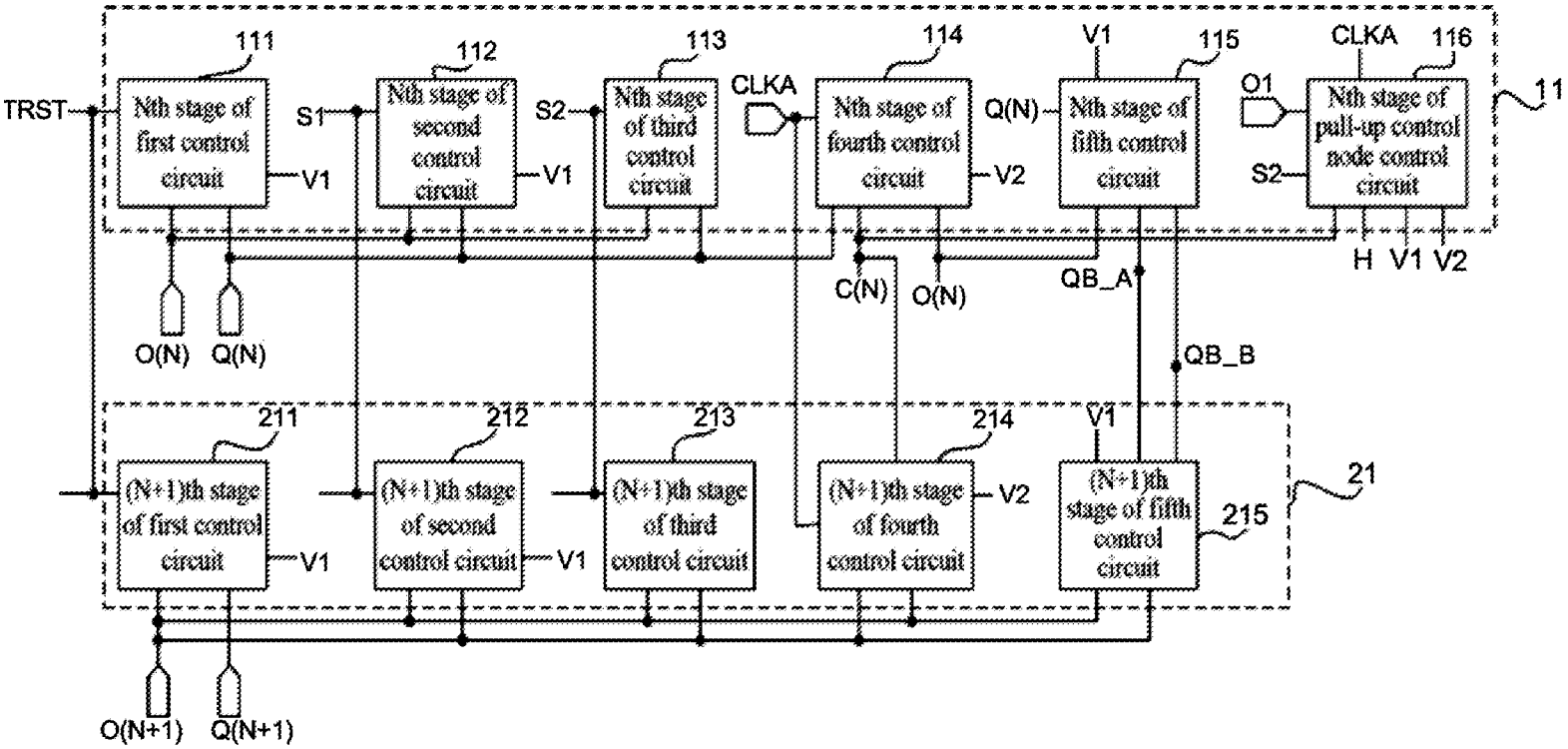
FIG. 4 is still yet another structural diagram of a gate driving unit according to at least one embodiment of the present disclosure.

As shown in FIG. 4, on the basis of the gate driving unit shown in FIG. 3 according to at least one embodiment of the present disclosure, the Nth stage of pull-up node control circuit 11 may further include an Nth stage of pull-up control node control circuit 116, the Nth stage of fourth control circuit 114, and the Nth stage of fifth control circuit 115.

The Nth stage of pull-up control node control circuit 116 is respectively connected to the enable terminal O1, the second pull-up control line S2, the first node H, the first voltage terminal, the second voltage terminal, the first clock signal terminal and the Nth stage of pull-up control node C(N), and under the control the enable signal provided by the enable terminal O1, based on the potential of the second pull-up control line S2, the first voltage V1 and the second The voltage V2, controls the potential of the first node H, and under the control of the potential of the first node H, controls the connection between the Nth stage of pull-up control node C(N) and the first clock signal terminal. The first clock signal terminal is used to provide a first clock signal CLKA; the first voltage terminal is used to provide the first voltage V1, and the second voltage terminal is used to provide the second voltage V2.

The Nth stage of fourth control circuit 114 is connected to the first clock signal terminal, the Nth stage of pull-up control node C(N), the Nth stage of control node O(N), and the Nth stage of pull-up node Q(N), respectively, under the control of the first clock signal CLKA, controls the connection between the Nth stage of pull-up control node C(N) and the Nth stage of control node O(N), and control the connection between the Nth stage of control node O(N) and the Nth stage of pull-up node Q(N), and under the control of the potential of the Nth stage of pull-up node Q(N), controls the connection between the Nth stage of control node O(N) and the second voltage terminal.

The Nth stage of fifth control circuit 115 is connected to the first pull-down node QB_A, the second pull-down node QB_B, the Nth stage of pull-up node Q(N), the Nth stage of control node O(N) and the first voltage terminal, and under the control of the potential of the first pull-down node QB_A, controls the connection between the Nth stage of pull-up node Q(N) and the Nth stage of control node O(N), and controls the connection between the Nth stage of control node O(N) and the first voltage terminal, and under the control of the potential of the second pull-down node QB_B, controls the connection between the Nth stage of pull-up node Q(N) and the Nth stage of control node O(N), and the connection between the Nth stage of control node O(N) and the first voltage terminal.

The (N+1)th stage of pull-up node control circuit 21 may further include an (N+1)th stage of fourth control circuit 214 and an (N+1)th stage of fifth control circuit 215.

The (N+1)th stage of fourth control circuit 214 is connected to the first clock signal terminal, the Nth stage of pull-up control node C(N), the (N+1)th stage of control node O(N+1) and the second voltage terminal, under the control of the first clock signal CLKA, controls the connection between the Nth stage of pull-up control node C(N) and the (N+1)th stage of control node O(N+1), and the connection between the (N+1)th stage of control node O(N+1) and the (N+1)th stage of pull-up node Q(N+1), and under the control of the potential of (N+1)th stage of pull-up node Q(N+1), controls the connection between the (N+1)th stage of control node O(N+1) and the second voltage terminal.

The (N+1)th stage of fifth control circuit 215 is respectively connected to the first pull-down node QB_A, the second pull-down node QB_B, the (N+1)th stage of pull-up node Q(N+1), and the (N+1)th stage of control node O(N+1) and the first voltage terminal, and the under the control of the potential of the first pull-down node QB_A, controls the connection between the (N+1)th stage of pull-up node Q(N+1) and the (N+1)th stage of control node O(N+1), and controls the connection between the (N+1)th stage of control node O(N+1) and the first voltage terminal, and under the control of the potential of QB_B, controls the connection between the (N+1)th stage of pull-up node Q(N+1) and the (N+1)th stage of control node O(N+1), and the connection between the (N+1)th stage of control node O(N+1) and the first voltage terminal.

In the gate driving unit described in at least one embodiment of the present disclosure, the second voltage V2 may be a high voltage VDD, but not limited thereto.

Optionally, the Nth stage of pull-up control node control circuit may include: a first transistor, a control electrode thereof being electrically connected to the enable terminal, and a first electrode thereof being electrically connected to the second pull-up control line; a second transistor, a control electrode thereof being electrically connected to the enable terminal, a first electrode thereof being electrically connected to the second electrode of the first transistor, and a second electrode thereof being electrically connected to the first voltage terminal; a third transistor, a control electrode thereof being electrically connected to the first node, a first electrode thereof being electrically connected to the second electrode of the first transistor, and a second electrode thereof being electrically connected to the second voltage terminal; a first capacitor, a first end thereof being electrically connected to the first node, and a second end thereof being electrically connected to the first voltage terminal; and a fourth transistor, a control electrode thereof being electrically connected to the first node, a first electrode thereof being electrically connected to the first clock signal terminal, and a second electrode thereof being electrically connected to the Nth stage of pull-up control node.

Optionally, the Nth stage of fourth control circuit may include a fifth transistor, a sixth transistor, and a tenth transistor. A control electrode of the fifth transistor is electrically connected to the first clock signal terminal, a first electrode of the fifth transistor is electrically connected to the Nth stage of pull-up control node, and a second electrode of the fifth transistor is electrically connected to the Nth stage of control node. A control electrode of the sixth transistor is electrically connected to the first clock signal terminal, a first electrode of the sixth transistor is electrically connected to the Nth stage of control node, and a second electrode of the sixth transistor is electrically connected to the Nth stage of pull-up node connection. A control electrode of the tenth transistor is electrically connected to the Nth stage of pull-up node, a first electrode of the tenth transistor is electrically connected to the Nth stage of control node, and a second electrode of the tenth transistor is electrically connected to the second voltage terminal.

Optionally, the Nth stage of fifth control circuit may include: a thirteenth transistor, a control electrode thereof being electrically connected to the first pull-down node, a first electrode thereof being electrically connected to the Nth stage of pull-up node, and a second electrode thereof being electrically connected to the Nth stage of control node; a fourteenth transistor, a control electrode thereof being electrically connected to the first pull-down node, a first electrode thereof being electrically connected to the Nth stage of control node, and a second electrode thereof being is electrically connected to the first voltage terminal; a fifteenth transistor, a control electrode thereof being electrically connected to the second pull-down node, a first electrode thereof being electrically connected to the Nth stage of pull-up node, and a second electrode thereof being is electrically connected to the Nth stage of control node; and a sixteenth transistor, a control electrode thereof being is electrically connected to the second pull-down node, a first electrode thereof being electrically connected to the Nth stage of control node, and a second electrode thereof being is electrically connected to the first voltage terminal.

Optionally, the (N+1)th stage of fourth control circuit may include a thirty third transistor, a thirty fourth transistor, and a thirty eighth transistor. A control electrode of the thirty third transistor is electrically connected to the first clock signal terminal, a first electrode of the thirty third transistor is electrically connected to the Nth stage of pull-up control node, and a second electrode of the thirty third transistor is electrically connected to the (N+1)th stage of control node. A control electrode of the thirty fourth transistor is electrically connected to the first clock signal terminal, a first electrode of the thirty fourth transistor is electrically connected to the (N+1)th stage of control node, and a second electrode of the thirty fourth transistor is electrically connected to the (N+1)th stage of pull-up node. A control electrode of the thirty eighth transistor is electrically connected to the (N+1)th stage of pull-up node, a first electrode of the thirty eighth transistor is electrically connected to the (N+1)th stage of control node, and a second electrode of the thirty eighth transistor is electrically connected to the second voltage terminal.

Optionally, the (N+1)th stage of fifth control circuit may include: a forty first transistor, a control electrode thereof being electrically connected to the first pull-down node, a first electrode thereof being electrically connected to the (N+1)th stage of pull-up node, and a second electrode thereof being electrically connected to the (N+1)th stage of control node; a forty second transistor, a control electrode thereof being electrically connected to the first pull-down node, a first electrode thereof being electrically connected to the (N+1)th stage of control node, and a second electrode thereof being electrically connected to the first voltage terminal; a forty third transistor, a control electrode thereof being electrically connected to the second pull-down node, a first electrode thereof being electrically connected to the (N+1)th stage of pull-up node, and a second electrode thereof being electrically connected to the (N+1)th stage of control node, and a forty fourth transistor, a control electrode thereof being electrically connected to the second pull-down node, a first electrode thereof being electrically connected to the (N+1)th stage of control node, and a second electrode thereof being is electrically connected to the first voltage terminal.

Optionally, the gate driving unit according to at least one embodiment of the present disclosure may further include a first pull-down node control circuit and a second pull-down node control circuit.

The first pull-down node control circuit is connected to the first control voltage terminal, the Nth stage of pull-up node, the first pull-down node, the first node, the first clock signal terminal, the first voltage terminal, and the second pull-up control line and the third low voltage terminal, and is used to control a potential of the first pull-down node under the control of the first control voltage, the potential of the Nth stage of pull-up node, the first clock signal, the potential of the first node, and the second pull-up control signal. The first control voltage terminal is used to provide a first control voltage.

The second pull-down node control circuit is connected to the second control voltage terminal, the (N+1)th stage of pull-up node, the second pull-down node, the first node, the first clock signal, the first voltage terminal, and the second pull-up control line and the third low voltage terminal, is used to control the potential of the second pull-down node under the control of the second control voltage, the potential of the (N+1)th stage of pull-up node, the first clock signal, the potential of the first node and the second pull-up control signal. The second control voltage terminal is used to provide a second control voltage.

In the gate driving unit according to at least one embodiment of the present disclosure, the first voltage terminal may be a first low voltage terminal, and the first voltage provided by the first voltage terminal may be a first low voltage, but not limited to this.

Optionally, the first pull-down node control circuit may include: a seventeenth transistor, a control electrode and a first electrode thereof being electrically connected to the first control voltage terminal; a first control voltage terminal being used to provide a first control voltage; an eighteenth transistor, a control electrode thereof being electrically connected to the second electrode of the seventeenth transistor, a first electrode thereof being electrically connected to the first control voltage terminal, and a second electrode thereof being electrically connected to the first pull-down node; a nineteenth transistor, a control electrode thereof being electrically connected to the Nth stage of pull-up node, a first electrode thereof being electrically connected to the control electrode of the eighteenth transistor, and a second electrode thereof being electrically connected to the third low voltage terminal; the third low voltage terminal being used to provide the third low voltage; a twentieth transistor, a control electrode thereof being electrically connected to the Nth stage of pull-up node, a first electrode thereof being electrically connected to the first pull-down node, and a second electrode thereof being electrically connected to the first low voltage terminal; the first low voltage terminal being used to provide the first low voltage; a twenty first transistor, a control electrode thereof being is electrically connected to the first clock signal terminal, and a first electrode thereof being electrically connected to the first pull-down node; a twenty second transistor, a control electrode thereof being electrically connected to the first node, a first electrode thereof being electrically connected to the second electrode of the twenty first transistor, and a second electrode thereof being electrically connected to the first low voltage terminal; and a twenty third transistor, a control electrode thereof being is electrically connected to the second pull-up control line, a first electrode thereof being electrically connected to the first pull-down node, and a second electrode thereof being electrically connected to the first low voltage terminal.

Optionally, the second pull-down node control circuit may include: a forty fifth transistor, a control electrode and a first electrode thereof being electrically connected to the second control voltage terminal; a forty sixth transistor, a control electrode thereof being is electrically connected to the second electrode of the forty fifth transistor, a first electrode thereof being is electrically connected to the second control voltage terminal, and a second electrode thereof being electrically connected to the second pull-down node, the second control voltage terminal being used to provide a second control voltage; a forty seventh transistor, a control electrode thereof being electrically connected to the (N+1)th stage of pull-up node, a first electrode thereof being electrically connected to the control electrode of the forty sixth transistor, and a second electrode thereof being electrically connected to the third low voltage terminal; a forty eighth transistor, a control electrode thereof being electrically connected to the (N+1)th stage of pull-up node, a first electrode thereof being electrically connected to the second pull-down node, and a second electrode thereof being electrically connected to the first low voltage terminal; a forty ninth transistor, a control electrode thereof being electrically connected to the first clock signal terminal, and a first electrode thereof being electrically connected to the second pull-down node; a fiftieth transistor, a control electrode thereof being electrically connected to the first node, a first electrode thereof being electrically connected to the second electrode of the forty ninth transistor, and a second electrode thereof being electrically connected to the first low voltage terminal; and a fifty first transistor, a control electrode thereof being electrically connected to the second pull-up control line, a first electrode thereof being electrically connected to the second pull-down node, and a second electrode thereof being electrically connected to the first low voltage terminal.

Optionally, the gate driving unit according to at least one embodiment of the present disclosure may further include an Nth stage of output circuit and an (N+1)th stage of output circuit.

The Nth stage of output circuit is connected to the Nth stage of pull-up node, the first pull-down node, the second pull-down node, the second clock signal terminal, the third clock signal terminal, the fourth clock signal terminal, the Nth stage of carry signal output terminal, the Nth stage of the first gate driving signal output terminal, the Nth stage of the second gate driving signal output terminal, and the second low voltage terminal, is used to, under the control of the potential of the Nth stage of pull-up node, the potential of the first pull-down node and the potential of the second pull-down node, control the Nth stage of carry signal outputted by the Nth stage of carry signal output terminal, the Nth stage of first gate driving signal outputted by the Nth stage of first gate driving signal output terminal and the Nth stage of second gate driving signal outputted by the Nth stage of second gate driving signal output terminal, the second clock signal terminal is used to provide a second clock signal, the third clock signal terminal is used to provide a third clock signal, and the fourth clock signal terminal is used to provide a fourth clock signal.

The (N+1) th output circuit is connected to the first pull-down node, the second pull-down node, the (N+1)th stage of pull-up node, a fifth clock signal terminal, a sixth clock signal terminal, and an (N+1)th stage of first gate driving signal output terminal, the (N+1)th stage of second gate driving signal output terminal and the second low voltage terminal, is used to, under the control of the potential of the (N+1)th stage of pull-up node, the potential of the first pull-down node and the potential of the second pull-down node, control the (N+1)th stage of first gate driving signal outputted by the (N+1)th stage of first gate driving signal output terminal and the (N+1)th stage of second gate driving signal outputted by the (N+1)th stage of second gate driving signal output terminal, the fifth clock signal terminal is used to provide a fifth clock signal, the sixth clock signal terminal is used to provide a sixth clock signal, and the seventh clock signal terminal is used to provide a seventh clock signal.

Optionally, the Nth stage of output circuit may include: a twenty fourth transistor, a control electrode thereof being electrically connected to the Nth stage of pull-up node, a first electrode thereof being connected to the second clock signal, and a second electrode thereof being electrically connected to the Nth stage of carry signal output terminal; a twenty fifth transistor, a control electrode thereof being electrically connected to the first pull-down node, a first electrode thereof being electrically connected to the Nth stage of carry signal output terminal, and a second electrode thereof being connected to the first low voltage; a twenty sixth transistor, a control electrode thereof being is electrically connected to the second pull-down node, a first electrode thereof being electrically connected to the Nth stage of carry signal output terminal, and a second electrode thereof being connected to the first low voltage; a twenty seventh transistor, a control electrode thereof being is electrically connected to the Nth stage of pull-up node, a first electrode thereof being connected to the third clock signal, and a second electrode thereof being is electrically connected to the Nth stage of first gate driving signal output terminal; a twenty eighth transistor, a control electrode thereof being electrically connected to the first pull-down node, a first electrode thereof being electrically connected to the output terminal of the Nth first gate driving signal, and a second electrode thereof being connected to the second low voltage; a twenty ninth transistor, a control electrode thereof being electrically connected to the second pull-down node, a first electrode thereof being electrically connected to the output terminal of the Nth stage of first gate driving signal, and the second electrode being connected to the second low voltage; a thirtieth transistor, a control electrode thereof being electrically connected to the Nth stage of pull-up node, a first electrode thereof being connected to the fourth clock signal, and a second electrode thereof being electrically connected to the output terminal of the Nth stage of second gate driving signal; a thirty first transistor, a control electrode thereof being electrically connected to the first pull-down node, a first electrode thereof being is electrically connected to the output terminal of the second gate driving signal of the Nth stage of, and a second electrode thereof being connected to the second low voltage; a thirty second transistor, a control electrode thereof being electrically connected to the second pull-down node, a first electrode thereof being electrically connected to the output terminal of the second gate driving signal of the Nth stage of, and a second electrode thereof being connected to the second low voltage; a second capacitor, a first end thereof being electrically connected to the Nth stage of pull-up node, and a second end thereof being electrically connected to the Nth stage of first gate driving signal output terminal; and a third capacitor, a first end thereof being electrically connected to the Nth stage of pull-up node, and a second end thereof being electrically connected to the Nth stage of second gate driving signal output terminal.

Optionally, the (N+1)th stage of output circuit may include: a fifty second transistor, a control electrode thereof being electrically connected to the (N+1)th stage of pull-up node, a first electrode thereof being connected to the fifth clock signal, and a second electrode thereof being electrically connected to the output terminal of the (N+1)th stage of first gate driving signal; a fifty third transistor, a control electrode thereof being electrically connected to the second pull-down node, a first electrode thereof being electrically connected to the (N+1)th stage of first gate driving signal output terminal, and a second electrode thereof being connected to the second low voltage; a fifty fourth transistor, a control electrode thereof being electrically connected to the first pull-down node, a first electrode thereof being electrically connected to the output terminal of the (N+1)th stage of the first gate driving signal, and a second electrode thereof being connected to the second low voltage; a fifty fifth transistor, a control electrode thereof being electrically connected to the (N+1)th stage of pull-up node, a first electrode thereof being connected to the sixth clock signal, and a second electrode thereof being electrically connected to the output terminal of the (N+1)th stage of second gate driving signal; a fifty sixth transistor, a control electrode thereof being electrically connected to the second pull-down node, a first electrode thereof being electrically connected to the output terminal of the (N+1)th stage of the second gate driving signal and a second electrode thereof being connected to the second low voltage; a fifty seventh transistor, a control electrode thereof being is electrically connected to the first pull-down node, a first electrode thereof being electrically connected to the output terminal of the (N+1)th stage of the second gate driving signal, and a second electrode thereof being connected to the second low voltage; a fourth capacitor, a first end thereof being electrically connected to the (N+1)th stage of pull-up node, and a second end thereof being electrically connected to the (N+1)th stage of first gate driving signal output terminal; and a fifth capacitor, a first end thereof being electrically connected to the (N+1)th-stage of pull-up node, and a second end thereof being electrically connected to the (N+1)th-stage of second gate driving signal output terminal.

Figure 5A:
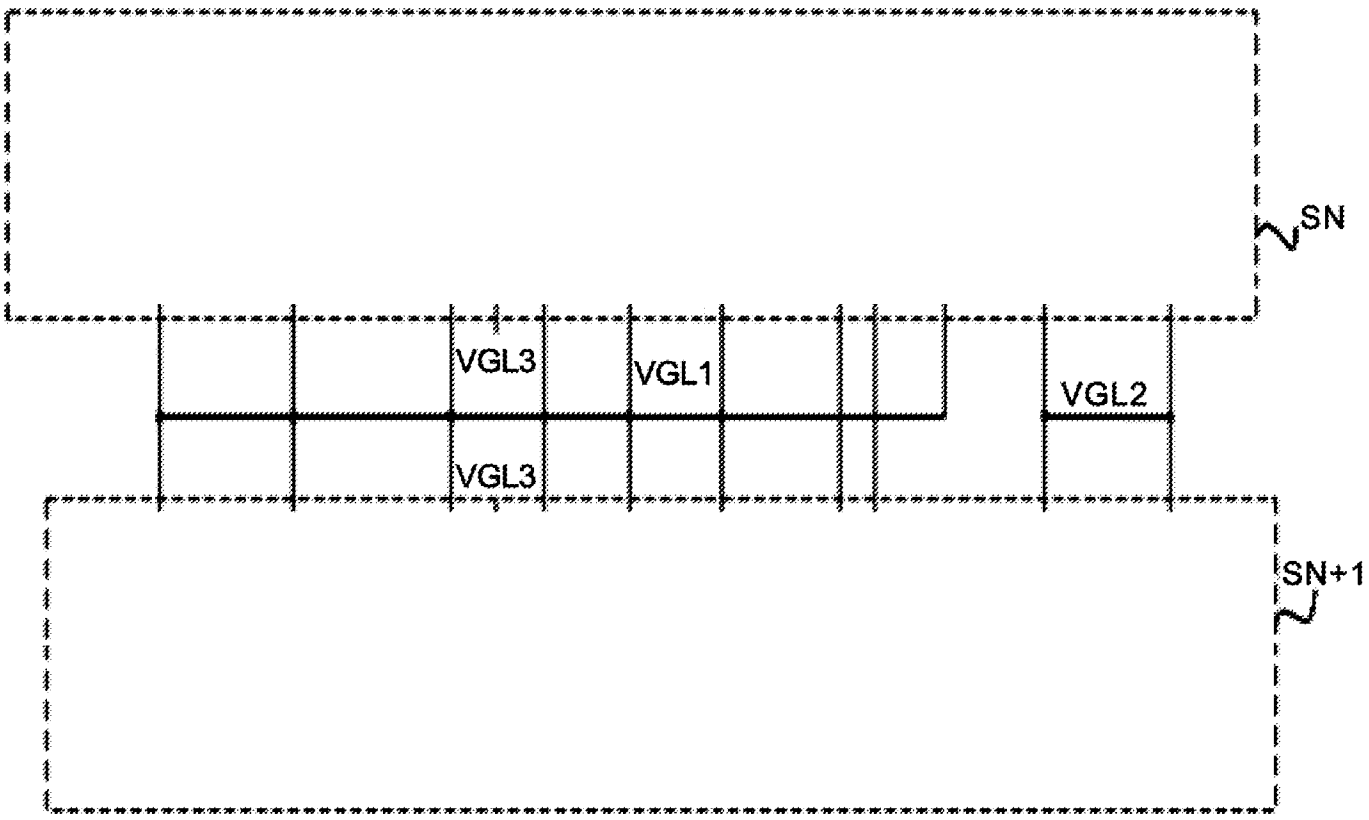
FIGS. 5A-5C are circuit diagrams of a gate driving unit according to at least one embodiment of the present disclosure.

As shown in FIG. 5A, the gate driving unit according to at least one embodiment of the present disclosure includes an Nth stage of shift register unit SN and an (N+1)th stage of shift register unit SN+1, where N is a positive integer.

The Nth stage of shift register unit SN includes an Nth stage of pull-up node control circuit, a first pull-down node control circuit, and an Nth stage of output circuit. The (N+1)th stage of shift register unit SN+1 includes an (N+1) th stage of pull-up node control circuit, a second pull-down node control circuit and an (N+1) th stage of output circuit. The Nth stage of pull-up node control circuit includes an Nth stage of first control circuit, an Nth stage of second control circuit, and an Nth stage of third control circuit. The (N+1)th stage of pull-up node control circuit includes an (N+1)th stage of first control circuit, an (N+1)th stage of second control circuit, and an (N+1)th stage of third control circuit.

The Nth stage of first control circuit includes a first control transistor M8 and a second control transistor M9. A gate electrode of the first control transistor M8 is electrically connected to the reset signal line TRST, a drain electrode of the first control transistor M8 is electrically connected to the Nth stage of pull-up node Q(N), and a source electrode of the first control transistor M8 is electrically connected to the Nth stage of control node O(N). A gate electrode of the second control transistor M9 is electrically connected to the reset signal line TRST, a drain electrode of the second control transistor M9 is electrically connected to the Nth stage of control node O(N), and a source electrode of the second control transistor M9 is electrically connected to the first low voltage terminal; the first low voltage terminal is used to provide a first low voltage VGL1.

The (N+1)th stage of first control circuit includes a third control transistor M36 and a fourth control transistor M37. A gate electrode of the third control transistor M36 is electrically connected to the reset signal line TRST, and a drain electrode of the third control transistor M36 is electrically connected to the (N+1)th stage of pull-up node Q(N+1), a source electrode of the third control transistor M36 is electrically connected to the (N+1)th stage of control node O(N+1). A gate electrode of the fourth control transistor M37 is electrically connected to the reset signal line TRST, and a drain electrode of the fourth control transistor M37 is electrically connected to the (N+1)th stage of control node O(N+1), and a source electrode of the fourth control transistor M37 is electrically connected to the first low voltage terminal.

The Nth stage of second control circuit includes a fifth control transistor M11 and a sixth control transistor M12. A gate electrode of the fifth control transistor M11 is electrically connected to the first pull-up control line S1, and a drain electrode of the fifth control transistor M11 is electrically connected to the Nth stage of pull-up node Q(N), and a source electrode of the fifth control transistor M11 is electrically connected to the Nth stage of control node O(N). A gate electrode of the sixth control transistor M12 is electrically connected to the first pull-up control line S1, a drain electrode of the sixth control transistor M12 is electrically connected to the Nth stage of control node O(N), and a source electrode of the sixth control transistor M12 is electrically connected to the first low voltage terminal.

The (N+1)th stage of second control circuit includes a seventh control transistor M39 and an eighth control transistor M40. A gate electrode of the seventh control transistor M39 is electrically connected to the first pull-up control line S1, and a drain electrode of the seventh control transistor M39 is connected to the (N+1) th stage of pull-up node Q(N+1), a source electrode of the seventh control transistor M39 is electrically connected to the (N+1)th stage of control node O(N+1). A gate electrode of the eighth control transistor M40 is electrically connected to the first pull-up control line S1, and a drain electrode of the eighth control transistor M40 is electrically connected to the (N+1)th stage of control node O(N+1), a source electrode of the eighth control transistor M40 is electrically connected to the first low voltage terminal.

The Nth stage of third control circuit includes a ninth control transistor M7_1 and a tenth control transistor M7_2. A gate electrode of the ninth control transistor M7_1 and a drain electrode of the ninth control transistor M7_1 are electrically connected to the second pull-up control line S2, a source electrode of the ninth control transistor M7_1 is electrically connected to the Nth stage of control node O(N). A gate electrode of the tenth control transistor M7_2 is electrically connected to the second pull-up control line S2, a drain electrode of the tenth control transistor M7_2 is electrically connected to the Nth stage of control node O(N), and a source electrode of the tenth control transistor M7_2 is electrically connected to the Nth stage of pull-up node Q(N).

The (N+1)th stage of third control circuit includes an eleventh control transistor M35_1 and a twelfth control transistor M35_2. A gate electrode of the eleventh control transistor M35_1 and a drain electrode of the eleventh control transistor M35_1 are electrically connected to the second pull-up control line S2, and a source electrode of the eleventh control transistor M35_1 is connected to the (N+1) th stage of control node O(N+1). A gate electrode of the twelfth control transistor M35_2 is electrically connected to the second pull-up control line S2, and a drain electrode of the twelfth control transistor M35_2 is connected to the (N+1) th stage of control node O(N+1), and a source electrode of the twelfth control transistor M35_2 is electrically connected to the (N+1)th stage of pull-up node Q(N+1).

The Nth stage of pull-up node control circuit further includes an Nth stage of pull-up control node control circuit, an Nth stage of fourth control circuit, and an Nth stage of fifth control circuit.

The (N+1)th stage of pull-up node control circuit further includes an (N+1)th stage of fourth control circuit and an (N+1)th stage of fifth control circuit.

The Nth stage of pull-up control node control circuit includes: a first transistor M1, a gate electrode thereof being electrically connected to the enable terminal O1, and a drain electrode thereof being electrically connected to the second pull-up control line S2; a second transistor M2, a gate electrode thereof being electrically connected to the enable terminal O1, a drain electrode thereof being electrically connected to the source electrode of the first transistor M1, and a source electrode thereof being electrically connected to the first low voltage terminal; a third transistor M3, a gate electrode thereof being electrically connected to the first node H, a drain electrode thereof being is electrically connected to the source electrode of the first transistor M1, and a source electrode thereof being electrically connected to a high voltage terminal; the high voltage terminal being used to provide a high voltage VDD; a first capacitor C1, a first end thereof being is electrically connected to the first node H, and a second end thereof being electrically connected to the first low voltage end; and a fourth transistor M4, a gate electrode thereof being electrically connected to the first node H, a drain electrode thereof being electrically connected to the first clock signal terminal, and a source electrode thereof being electrically connected to the Nth stage of pull-up control node C(N). The clock signal terminal is used to provide a first clock signal CLKA.

The Nth stage of fourth control circuit includes a fifth transistor M5, a sixth transistor M6, and a tenth transistor M10. A gate electrode of the fifth transistor M5 is electrically connected to the first clock signal terminal, a drain electrode of the fifth transistor M5 is electrically connected to the Nth stage of pull-up control node C(N), and a source electrode of the fifth transistor M5 is The Nth stage of control node O(N) is electrically connected. A gate electrode of the sixth transistor M6 is electrically connected to the first clock signal terminal, a drain electrode of the sixth transistor M6 is electrically connected to the Nth stage of control node O(N), and a source electrode of the sixth transistor M6 is connected to the Nth stage of pull-up node Q(N). A gate electrode of the tenth transistor M10 is electrically connected to the Nth stage of pull-up node Q(N), a drain electrode of the tenth transistor M10 is electrically connected to the Nth stage of control node O(N), and a source electrode of the tenth transistor M10 is electrically connected to the high voltage terminal; the high voltage terminal is used to provide a high voltage VDD.

The Nth stage of fifth control circuit includes: a thirteenth transistor M13, a gate electrode thereof being electrically connected to the first pull-down node QB_A, a drain electrode thereof being electrically connected to the Nth stage of pull-up node Q(N), and a source electrode thereof being connected to the Nth stage of control node O(N); a fourteenth transistor M14, a gate electrode thereof being electrically connected to the first pull-down node QB_A, a drain electrode thereof being electrically connected to the Nth stage of control node O(N), and a source electrode thereof being electrically connected to the first low voltage terminal; a fifteenth transistor M15, a control electrode thereof being electrically connected to the second pull-down node QB_B, a drain electrode thereof being is electrically connected to the Nth stage of pull-up node Q(N), and a source electrode thereof being electrically connected to the Nth stage of control node O(N); a sixteenth transistor M16, a gate electrode thereof being electrically connected to the second pull-down node QB_B, a drain electrode thereof being electrically connected to the Nth stage of control node O(N), and a source electrode thereof being electrically connected to the first low voltage terminal.

The (N+1)th stage of fourth control circuit includes a thirty third transistor M33, a thirty fourth transistor M34, and a thirty eighth transistor M38. A gate electrode of the thirty third transistor M33 is electrically connected to the first clock signal terminal, a drain electrode of the thirty third transistor M33 is electrically connected to the Nth stage of pull-up control node C(N), a source electrode of the thirty third transistor M33 is electrically connected to the (N+1)th stage of control node O(N+1). A gate electrode of the thirty fourth transistor M34 is electrically connected to the first clock signal terminal, a drain electrode of the thirty fourth transistor M34 is electrically connected to the (N+1)th stage of control node O(N+1), a source electrode of the fourteen transistor M34 is electrically connected to the (N+1)th stage of pull-up node Q(N+1). A gate electrode of the thirty eighth transistor M38 is electrically connected to the (N+1)th stage of pull-up node Q(N+1), and a drain electrode of the thirty eighth transistor M38 is connected to the (N+1)th stage of control node O(N+1), and a source electrode of the thirty eighth transistor M38 is electrically connected to the second voltage terminal.

The (N+1)th stage of fifth control circuit includes: a forty first transistor M41, a gate electrode thereof being electrically connected to the first pull-down node QB_A, a drain electrode thereof being electrically connected to the (N+1)th stage of pull-up node Q(N+1), and a source electrode thereof being connected to the (N+1)th stage of control node O(N+1); a forty second transistor M42, a gate electrode thereof being electrically connected to the first pull-down node QB_A, a drain electrode thereof being electrically connected to the (N+1)th stage of control node O(N+1), and a source electrode thereof being electrically connected to the first low voltage terminal; a forty third transistor M43, a gate electrode thereof being electrically connected to the second pull-down node QB_B, a drain electrode thereof being is electrically connected to the (N+1)th stage of pull-up node Q(N+1), and a source electrode thereof being connected to the (N+1)th stage of control node O(N+1); a forty fourth transistor M44, a gate electrode thereof being electrically connected to the second pull-down node QB_B, a drain electrode thereof being electrically connected to the (N+1)th stage of control node O(N+1), and a source electrode thereof being electrically connected to the first low voltage terminal.

The first pull-down node control circuit may include: a seventeenth transistor M17, both gate electrode and drain electrode thereof being electrically connected to the first control voltage terminal; the first control voltage terminal is used to provide a first control voltage VDD_A; an eighteenth transistor M18, a gate electrode thereof being electrically connected to the source electrode of the seventeenth transistor M17, a drain electrode thereof being electrically connected to the first control voltage terminal, and a source electrode thereof being is electrically connected to the first pull-down node QB_A; a nineteenth transistor M19, a gate electrode thereof being electrically connected to the Nth stage of pull-up node Q(N), a drain electrode thereof being electrically connected to the gate electrode of the eighteenth transistor M18, and a source electrode thereof being electrically connected to the third low voltage terminal, the third low voltage terminal being used to provide a third low voltage VGL3; a twentieth transistor M20, a gate electrode thereof being electrically connected to the Nth stage of pull-up node Q(N), a drain electrode thereof being electrically connected to the first pull-down node QB_A, and a source electrode thereof being electrically connected to the first low voltage terminal, the first low voltage terminal being used to provide a first low voltage VGL1; a twenty first transistor M21, a gate electrode thereof being electrically connected to the first clock signal terminal, and a drain electrode thereof being electrically connected to the first pull-down node QB_A; and a twenty second transistor M22, a gate electrode thereof being electrically connected to the first node H, a drain electrode thereof being electrically connected to the source electrode of the twenty first transistor M21, and a source electrode thereof being electrically connected to the first low voltage terminal; a twenty third transistor M23, a gate electrode thereof being electrically connected to the second pull-up control line S2, a drain electrode thereof being electrically connected to the first pull-down node QB_A, and a source electrode thereof being electrically connected to the first low voltage terminal.

The second pull-down node control circuit includes: a forty fifth transistor M45, both gate electrode and drain electrode thereof being electrically connected to the second control voltage terminal; a forty sixth transistor M46, a gate electrode thereof being electrically connected to the source electrode of the forty fifth transistor M45, a drain electrode thereof being electrically connected to the second control voltage terminal, and a source electrode thereof being electrically connected to the second pull-down node QB_B, the second control voltage terminal being used to provide a second control voltage VDD_B; a forty seventh transistor M47, a gate electrode thereof being electrically connected to the (N+1)th stage of pull-up node Q(N+1), a drain electrode thereof being electrically connected to the gate electrode of the forty sixth transistor M46, and a source electrode thereof being connected to the third voltage terminal, the third low voltage terminal being used to provide a third low voltage VGL3; a forty eighth transistor M48, a gate electrode thereof being electrically connected to the (N+1)th stage of pull-up node Q(N+1), a drain electrode thereof being electrically connected to the second pull-down node QB_B, and a source electrode thereof being electrically connected to the first low voltage terminal; a forty ninth transistor M49, a gate electrode thereof being electrically connected to the first clock signal terminal, and a drain electrode thereof being electrically connected to the second pull-down node QB_B; a fiftieth transistor M50, a gate electrode thereof being electrically connected to the first node H, a drain electrode thereof being electrically connected to the source electrode of the forty ninth transistor M49, and a source electrode thereof being electrically connected to the first low voltage terminal; and a fifty first transistor M51, a gate electrode thereof being electrically connected to the second pull-up control line S2, a drain electrode thereof being electrically connected to the second pull-down node QB_B, and a source electrode thereof being electrically connected to the first low voltage terminal.

The Nth stage of output circuit includes: a twenty fourth transistor M24, a gate electrode thereof being electrically connected to the Nth stage of pull-up node Q(N), a drain electrode thereof being connected to the second clock signal CLKD_1, and a source electrode thereof being electrically connected to the Nth stage of carry signal output terminal CR(N); a twenty fifth transistor M25, a gate electrode thereof being electrically connected to the first pull-down node QB_A, a drain electrode thereof being electrically connected to the Nth stage of carry signal output terminal CR(N), and a source electrode thereof being connected to the first low voltage VGL1; a twenty sixth transistor M26, a gate electrode thereof being electrically connected to the second pull-down node QB_B, a drain electrode thereof being electrically connected to the Nth stage of carry signal output terminal CR(N), and a source electrode thereof being connected to the first low voltage VGL1; a twenty seventh transistor M27, a gate electrode thereof being electrically connected to the Nth stage of pull-up node Q(N), a drain electrode thereof being connected to the third clock signal CLKE_1, and a source electrode thereof being connected to the Nth stage of first gate driving signal output terminal OUT1(N); a 28th transistor M28, a gate electrode thereof being electrically connected to the first pull-down node QB_A, a drain electrode thereof being electrically connected to the Nth stage of first gate driving signal output terminal OUT1(N) and a source electrode thereof being connected to the second Low voltage VGL2; a twenty ninth transistor M29, a gate electrode thereof being electrically connected to the second pull-down node QB_B, a drain electrode thereof being electrically connected to the Nth stage of the first gate driving signal output terminal OUT1(N), and a source electrode thereof being connected to the second low Voltage VGL2; a thirtieth transistor M30, a gate electrode thereof being electrically connected to the Nth stage of pull-up node Q(N), a drain electrode thereof being is connected to the fourth clock signal CLKF_1, and a source electrode thereof being is connected to the Nth stage of second gate driving signal output terminal OUT2(N); a thirty first transistor M31, a gate electrode thereof being electrically connected to the first pull-down node QB_A, a drain electrode thereof being electrically connected to the Nth stage of second gate driving signal output terminal OUT2(N), and a source electrode thereof being connected to the second low voltage VGL2; a thirty second transistor M32, a gate electrode thereof being electrically connected to the second pull-down node QB_B, a drain electrode thereof being is electrically connected to the Nth stage of second gate driving signal output terminal OUT2(N), and a source electrode thereof being connected to the second low voltage VGL2; a second capacitor C2, a first end thereof being electrically connected to the Nth stage of pull-up node Q(N), and a second end thereof being electrically connected to the Nth stage of first gate driving signal output terminal OUT1(N); and a third capacitor C3, a first end thereof being electrically connected to the Nth stage of pull-up node Q(N), and a second end thereof being electrically connected to the Nth stage of second gate driving signal output terminal OUT2(N).

The (N+1)th stage of output circuit includes: a fifty second transistor M52, a gate electrode thereof being electrically connected to the (N+1)th stage of pull-up node Q(N+1), a drain electrode thereof being connected to the fifth clock signal CLKE_2, and a source electrode thereof being connected to the (N+1)th stage of the first gate driving signal output terminal OUT1(N+1); a fifty third transistor M53, a gate electrode thereof being electrically connected to the second pull-down node QB_B, a drain electrode thereof being electrically connected to the (N+1)th stage of first gate driving signal output terminal OUT1(N+1), and a source electrode thereof being connected to the second low voltage VGL2; a fifty fourth transistor M54, a gate electrode thereof being electrically connected to the first pull-down node QB_A, a drain electrode thereof being electrically connected to the (N+1)th stage of first gate driving signal output terminal OUT(N+1), and a source electrode thereof being connected to the second low voltage VGL2; a fifty fifth transistor M55, a gate electrode thereof being electrically connected to the (N+1)th stage of pull-up node Q(N+1), a drain electrode thereof being connected to the sixth clock signal CLKF_2, and a source electrode thereof being connected to the (N+1)th stage of second gate driving signal output terminal OUT2(N+1); a fifty sixth transistor M56, a gate electrode thereof being electrically connected to the second pull-down node QB_B, a drain electrode thereof being electrically connected to the (N+1)th stage of second gate driving signal output terminal OUT2(N+1), and a source electrode thereof being connected to the second low voltage VGL2; a fifty seventh transistor M57, a gate electrode thereof being electrically connected to the first pull-down node QB_A, a drain electrode thereof being electrically connected to the (N+1)th stage of second gate driving signal output terminal OUT2(N+1), and a source electrode thereof being connected to the second Low voltage VGL2; a fourth capacitor C4, a first end thereof being electrically connected to the (N+1)th stage of pull-up node Q(N+1), and a second end thereof being connected to the (N+1)th stage of first gate driving signal output terminal OUT1(N+1); and a fifth capacitor C5, a first end thereof being electrically connected to the (N+1)th stage of pull-up node Q(N+1), and a second end thereof being connected to the (N+1)th stage of second gate driving signal output terminal OUT2(N+1).

In the gate driving unit according to at least one embodiment of the present disclosure shown in FIG. 5, the first pull-up control line S1 is electrically connected to the (N+8)th stage of the carry signal terminal, and the second pull-up control line S2 is electrically connected to the (N−4)th stage of the carry signal output, but not limited to this.

Figure 5B:
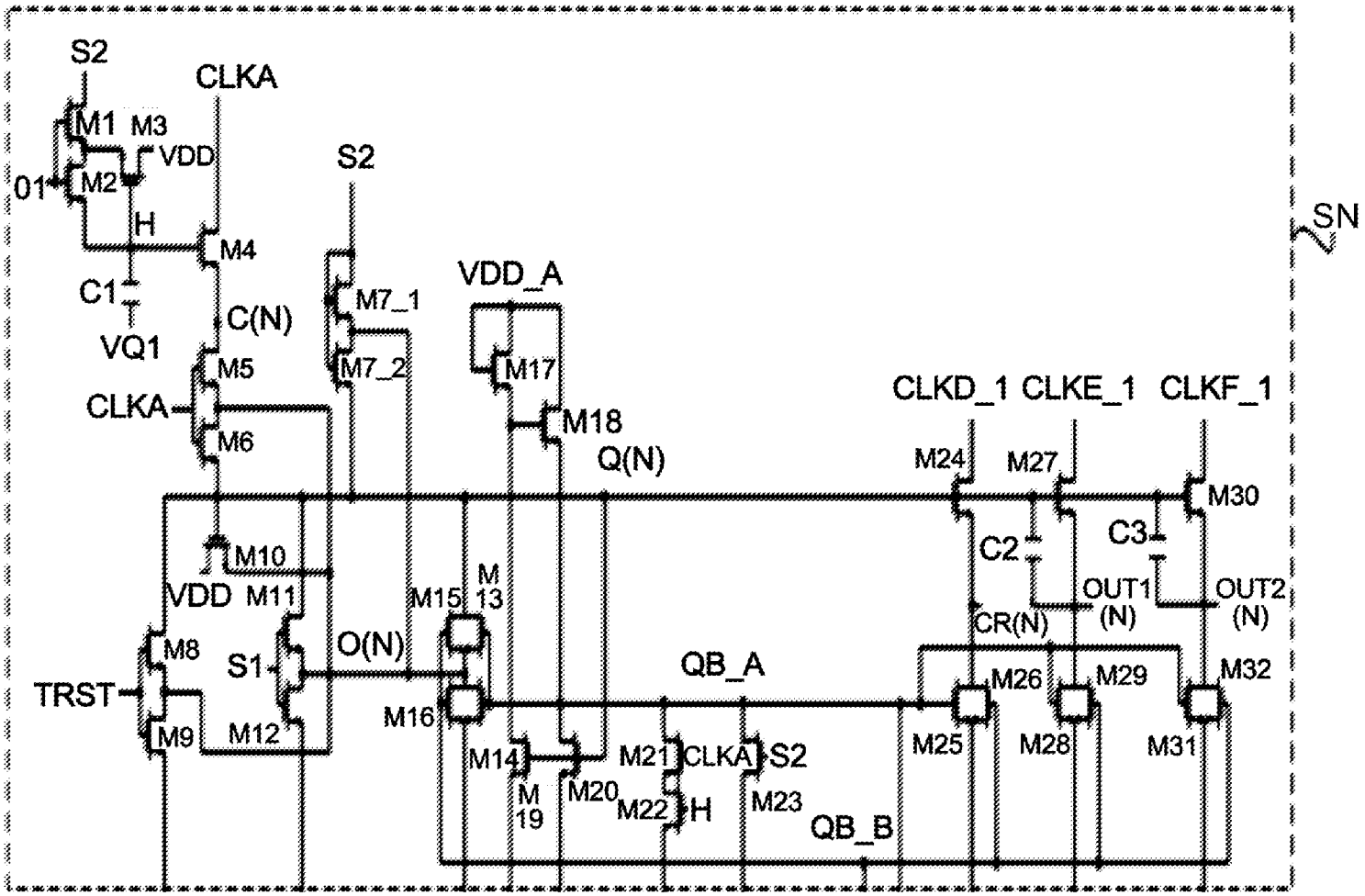
Figure 5C:
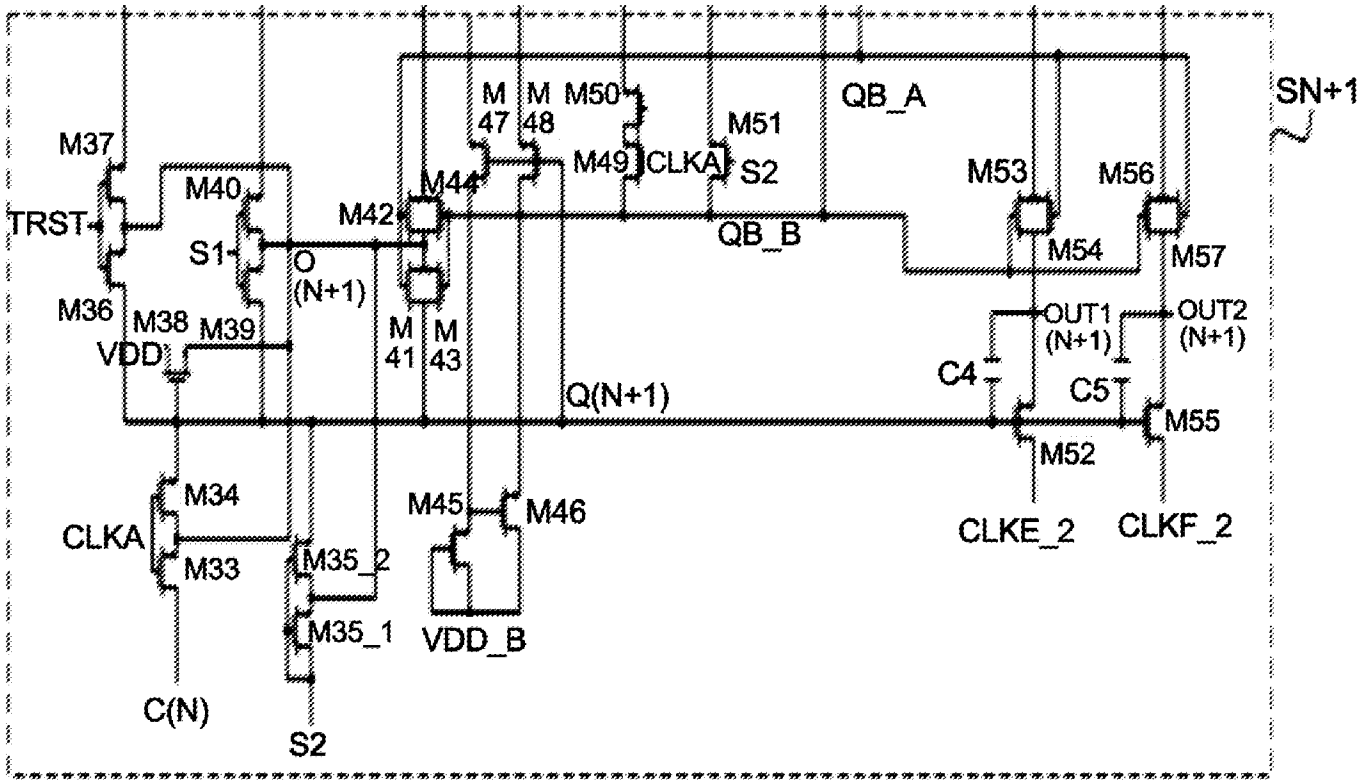

In the gate driving unit described in at least one embodiment of the present disclosure shown in FIGS. 5A-5C, the first voltage terminal is a first low voltage terminal, and the second voltage terminal is a high voltage terminal, but not limited thereto.

In the gate driving unit described in at least one embodiment of the present disclosure shown in FIGS. 5A-5C, all transistors are n-type thin film transistors, but not limited to this.

Figure 6:
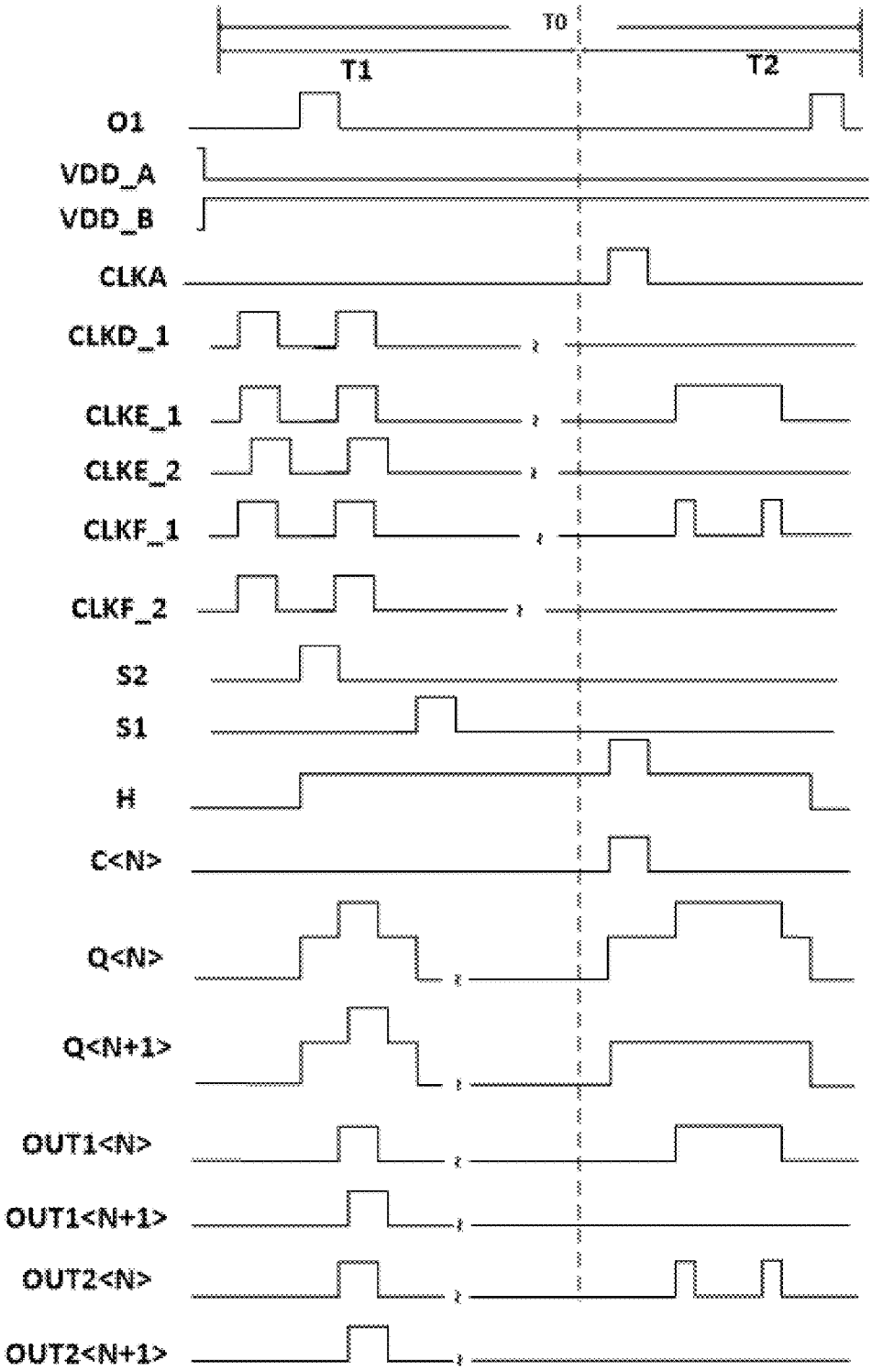
FIG. 6 is a timing sequence diagram of the gate driving unit shown in FIGS. 5A-5C according to at least one embodiment of the present disclosure.

FIG. 6 is a timing sequence diagram of the gate driving unit shown in FIGS. 5A-5C according to at least one embodiment of the present disclosure.

In FIG. 6, the label TO is one frame of display time, the label T1 is a display phase, and the label T2 is a touch phase.

As shown in FIG. 6, in the display phase T1, the waveform of Q(N) and the waveform of Q(N+1) are the same.

The gate driving circuit according to at least one embodiment of the present disclosure includes a plurality of the above gate driving units.

The display substrate according to at least one embodiment of the present disclosure includes a base substrate and the above-mentioned gate driving circuit provided on the base substrate.

Optionally, there may be an X axis parallel to the gate line between the Nth stage of shift register unit included in the gate driving unit and the (N+1)th stage of shift register unit included in the gate driving unit.

The Nth stage of pull-up node control circuit includes an Nth stage of first control circuit, an Nth stage of second control circuit, and an Nth stage of third control circuit, and the (N+1)th stage of pull-up node control circuit includes an (N+1)th stage of first control circuit, an (N+1)th stage of second control circuit and an (N+1)th stage of third control circuit.

The Nth stage of first control circuit includes a first control transistor and a second control transistor, the (N+1) th stage of first control circuit includes a third control transistor and a fourth control transistor; the Nth stage of second control circuit includes a fifth control transistor and a sixth control transistor, the (N+1)th stage of second control circuit includes a seventh control transistor and an eighth control transistor; the Nth stage of third control circuit includes a ninth control transistor and a tenth control transistor, the (N+1)th stage of third control circuit includes an eleventh control transistor and a twelfth control transistor.

The first control transistor and the third control transistor are arranged symmetrically on both sides of the X axis.

The second control transistor and the fourth control transistor are arranged symmetrically on both sides of the X axis.

The fifth control transistor and the seventh control transistor are arranged symmetrically on both sides of the X axis.

The sixth control transistor and the eighth control transistor are symmetrically arranged on both sides of the X axis.

The ninth control transistor and the eleventh control transistor are symmetrically arranged on both sides of the X axis.

The tenth control transistor and the twelfth control transistor are symmetrically arranged on both sides of the X axis.

In specific implementation, the Nth stage of shift register unit and the (N+1)th stage of shift register unit share the reset signal line, the first pull-up control line and the second pull-up control line, and there may be an X axis parallel to the gate line between the Nth stage of shift register unit and the (N+1)th stage of shift register units.

The first control transistor included in the Nth stage of the first control circuit and the third control transistor included in the (N+1)th stage of first control circuit are symmetrically arranged on both sides of the X axis, and the second control transistor included in the Nth stage of the first control circuit and the third control transistor included in the (N+1)th stage of first control circuit are symmetrically arranged on both sides of the X axis.

The first control transistor, the second control transistor, the third control transistor and the fourth control transistor are all electrically connected to the reset signal line. Therefore, the length of the line between the reset signal line and the first control transistor is substantially the same as the length of the line between the reset signal line and the third control transistor, so that the waveform of the reset signal received by the first control transistor and the waveform of the reset signal received by the third control transistor is basically the same, and the length of the line between the reset signal line and the second control transistor is substantially the same as the length of the line between the reset signal line and the fourth control transistor, so that the waveform of the reset signal received by the first control transistor is substantially the same as the waveform of the reset signal received by the third control transistor, which can prevent display abnormality due to the difference of the length of signal lines.

The fifth control transistor, the sixth control transistor, the seventh control transistor, and the eighth control transistor are all electrically connected to the first pull-up control line. Therefore, the length of the line between the first pull-up control line and the fifth control transistor is substantially the same as the length of the line between the first pull-up control line and the seventh control transistor, so that waveform of the first pull-up control signal received by the fifth control transistor is substantially the same as the waveform of the first pull-up control signal received by the seventh control transistor, and the length of the line between the first pull-up control line and the sixth control transistor, and the length of the line between the first pull-up control line and the eighth control transistor is substantially the same, so that the waveform of the first pull-up control signal received by the sixth control transistor is basically the same as the waveform of the first pull-up control signal received by the eighth control transistor, which can prevent the display abnormality caused by the difference of the length of signal lines.

The ninth control transistor, the tenth control transistor, the eleventh control transistor and the twelfth control transistor are all electrically connected to the second pull-up control line. Therefore, the length of the line between the second pull-up control line and the ninth control transistor and the length of the line between the second pull-up control line and the eleventh control transistor are substantially the same, so that the waveform of the second pull-up control signal is substantially the same as the waveform of the second pull-up control signal received by the eleventh control transistor, and the length of the line between the second pull-up control line and the tenth control transistor and the length of the line between the second pull-up control line and the twelfth control transistor are substantially the same, so that the waveform of the second pull-up control signal received by the tenth control transistor is basically the same as the waveform of the second pull-up control signal received by the twelfth control transistor, which can prevent the display abnormality caused by the difference of length of signal lines.

In addition, two stages of adjacent gate driving units share the reset signal line, the first pull-up control line and the second pull-up control line, which can reduce the crossover between signal lines as much as possible and reduce the parasitic capacitance caused by the crossover and ensure the operation stability of the gate driving circuit.

In addition, the distance between the first line connected to the corresponding transistor in the Nth stage of shift register unit and the (N+1)th stage of pull-up node and the second line connected to the corresponding transistor in the (N+1)th stage of shift register unit and the (N+1)th stage of pull-up node is very small, but since the waveform of the potential of the Nth stage of pull-up node is the same as the waveform of the potential of the (N+1)th stage of pull-up node during the display phase T1, even if the distance between the first line and the second line is very small, and a short circuit occurs, which will not affect the normal display of the display panel and increase the fault tolerance rate.

Optionally, there is an X axis parallel to the gate line between of the Nth stage of shift register unit included in the gate driving unit and the (N+1)th stage of shift register unit included in the gate driving unit.

The Nth stage of pull-up node control circuit includes an Nth stage of pull-up control node control circuit, an Nth stage of fourth control circuit, and an Nth stage of fifth control circuit; the (N+1)th stage of pull-up node control circuit includes (N+1)th stage of fourth control circuit and (N+1)th stage of fifth control circuit.

The Nth stage of fifth control circuit includes a thirteenth transistor, a fourteenth transistor, a fifteenth transistor, and a sixteenth transistor, and the (N+1)th stage of fifth control circuit includes a forty first transistor, a forty second transistor, forty third transistor and forty fourth transistor.

The thirteenth transistor and the forty third transistor are symmetrically arranged on both sides of the X axis, the fourteenth transistor and the forty fourth transistor are symmetrically arranged on both sides of the X axis, and the fifteenth transistor and the forty first transistor are symmetrically arranged on both sides of the X axis, and the sixteenth transistor and the forty second transistor are symmetrically arranged on both sides of the X axis.

Optionally, the Nth stage of the fifth control circuit may include: the thirteenth transistor, a control electrode thereof being electrically connected to the first pull-down node, a first electrode thereof being electrically connected to the Nth stage of pull-up node, and a second electrode thereof being electrically connected to the Nth stage of control node; the fourteenth transistor, a control electrode thereof being electrically connected to the first pull-down node, a first electrode thereof being electrically connected to the Nth stage of control node, and a second electrode thereof being electrically connected to the first voltage terminal; the fifteenth transistor, a control electrode thereof being electrically connected to the second pull-down node, a first electrode thereof being electrically connected to the Nth stage of pull-up node, and a second electrode thereof being electrically connected to the Nth stage of control node; the sixteenth transistor, a control electrode thereof being electrically connected to the second pull-down node, a first electrode thereof being electrically connected to the Nth stage of control node, and a second electrode thereof being electrically connected to the first voltage terminal.

The (N+1)th stage of fifth control circuit may include: a forty first transistor, a control electrode thereof being electrically connected to the first pull-down node, a first electrode thereof being electrically connected to the (N+1)th stage of pull-up node, and a second electrode thereof being electrically connected to the (N+1)th stage of control node; a forty second transistor, a control electrode thereof being electrically connected to the first pull-down node, a first electrode thereof being electrically connected to the (N+1)th stage of control node, and a second electrode thereof being electrically connected to the first voltage terminal; a forty third transistor, a control electrode thereof being electrically connected to the second pull-down node, a first electrode thereof being electrically connected to the (N+1)th stage of pull-up node, and a second electrode thereof being electrically connected to the (N+1)th stage of control node; and a forty fourth transistor, a control electrode thereof being electrically connected to the second pull-down node, a first electrode thereof being electrically connected to the (N+1)th stage of control node, and a second electrode thereof being electrically connected to the first voltage terminal.

In at least one embodiment of the present disclosure, the distance between the first line connected to the corresponding transistor in the Nth stage of shift register unit and the (N+1)th stage of pull-up node and the second line connected to the corresponding transistor in the (N+1)th stage of shift register unit and the (N+1)th stage of pull-up node are very small, and the Nth stage of shift register unit and the (N+1)th stage of shift register unit share the first pull-down node and the second pull-down node. Therefore, the potential of the first pull-down node received by the control electrode of the thirteenth transistor and the control electrode of the fourteenth transistor, and the potential of the first pull-down node received by the control electrode of the forty first transistor and the control electrode of the forty second transistor are substantially the same, and the potential of the second pull-down node received by the control electrode of the fifteenth transistor and the control electrode of the sixteenth transistor and the potential of the second pull-down node received by the control electrode of the forty third transistor and the control electrode of the forty fourth transistor are substantially the same, which can prevent display abnormality due to the difference of length of signal lines.

Figure 7:
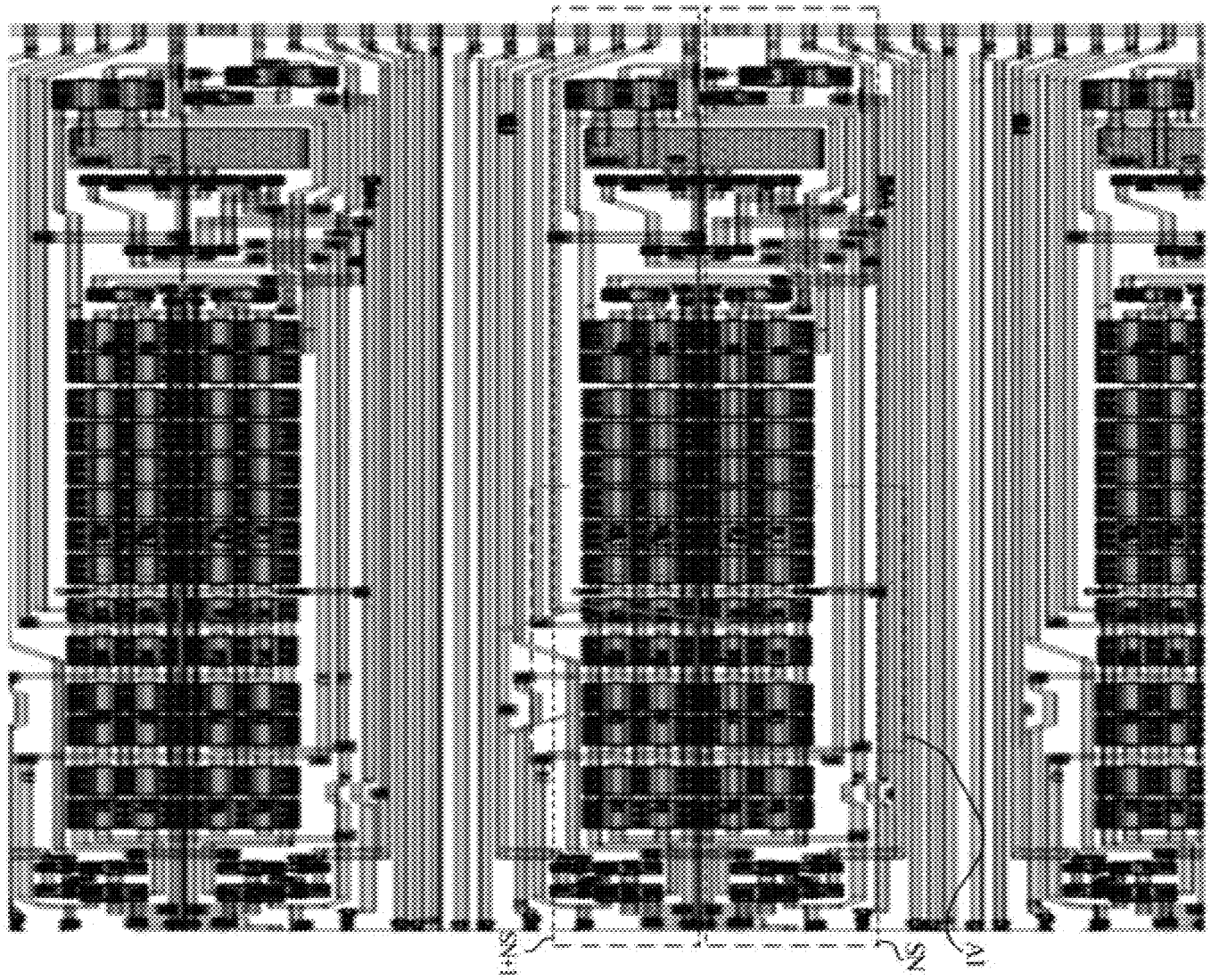
FIG. 7 is a layout diagrams of transistors in the Nth stage of shift register unit SN included in the gate driving unit as shown in FIGS. 5A-5C and transistors in the (N+1)th stage of shift register unit SN+1 included in the gate driving unit according to at least one embodiment of the present disclosure.

FIG. 7 is a layout diagram of transistors in the Nth stage of shift register unit SN included in the gate driving unit shown in FIG. 5B according to at least one embodiment of the present disclosure and the layout diagram of the transistors in the (N+1)th stage of shift register unit SN+1 included in the gate driving unit as shown in FIG. 5C according to at least one embodiment.

Figure 8:
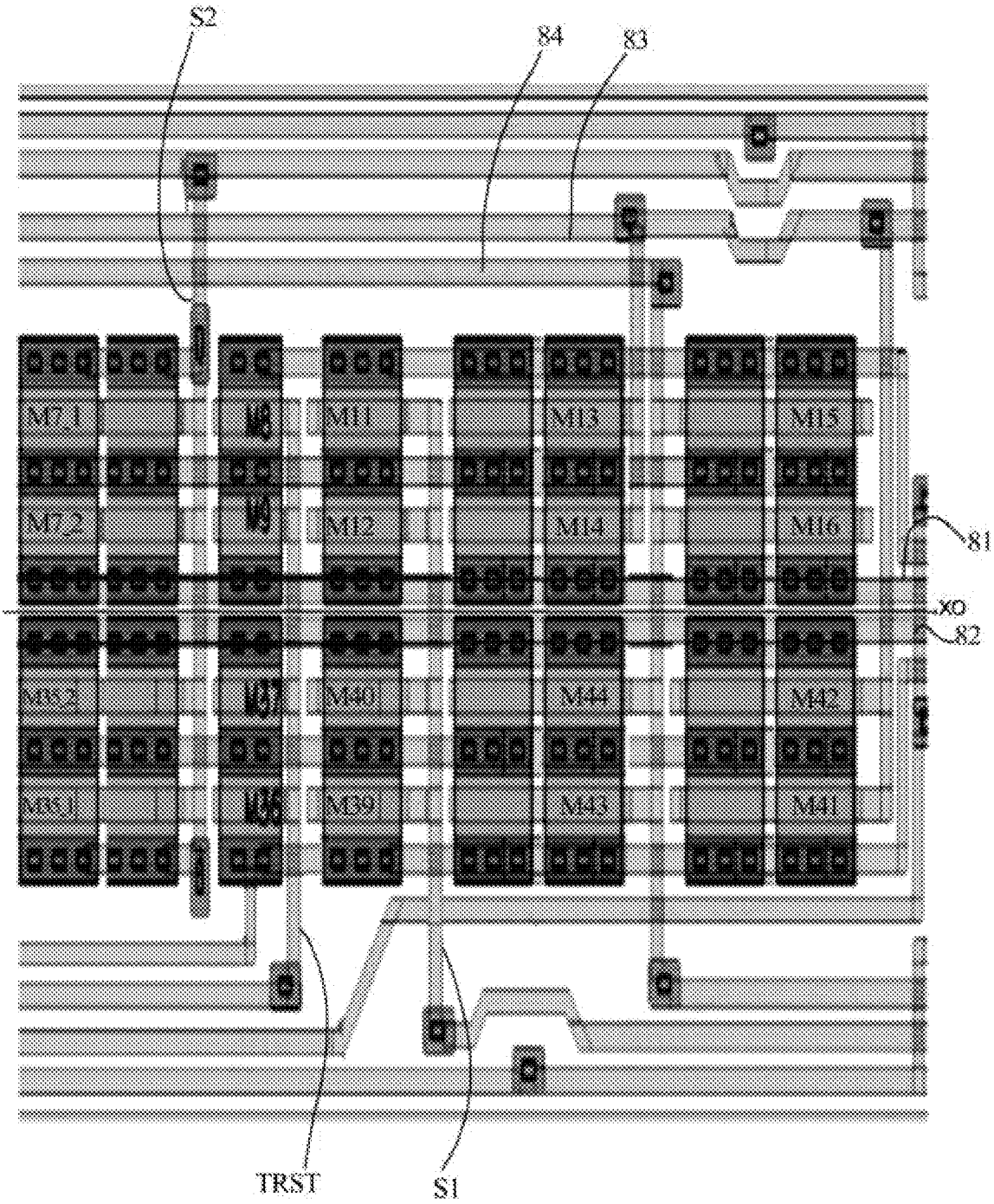
FIG. 8 is an enlarged schematic view of a first area A1 in FIG. 7.

FIG. 8 is an enlarged schematic view of the first area A1 in FIG. 7.

As shown in FIG. 8, there is an X axis X0 parallel to the gate line between the Nth stage of shift register unit included in the gate driving unit and the (N+1)th stage of shift register unit included in the gate driving unit (The X axis X0 is drawn to show the symmetrical relationship of transistors).

As shown in FIG. 8, the first control transistor M8 and the third control transistor M36 are arranged symmetrically on both sides of the X axis X0.

The second control transistor M9 and the fourth control transistor M37 are symmetrically arranged on both sides of the X axis X0.

The fifth control transistor and the seventh control transistor M39 of M11 are symmetrically arranged on both sides of the X axis X0.

The sixth control transistor M12 and the eighth control transistor M40 are arranged symmetrically on both sides of the X axis X0.

The ninth control transistor M7_1 and the eleventh control transistor M35_1 are symmetrically arranged on both sides of the X axis X0.

The tenth control transistor M7_2 and the twelfth control transistor M35_2 are symmetrically arranged on both sides of the X axis X0.

In FIG. 8, label S1 represents the first pull-up control line, label S2 represents the second pull-up control line, label TRST represents the reset signal line, and label 81 represents the first line connected to the Nth stage of pull-up node, label 82 represents the second line connected to the (N+1)th stage of pull-up node, label 83 represents the third line connected to the first pull-down node, label 84 represents the fourth line connected to the second pull-down node.

In FIG. 8, M13 is the thirteenth transistor, M14 is the fourteenth transistor, M15 is the fifteenth transistor, M16 is the sixteenth transistor, and M43 is the forty third transistor, M44 is the forty fourth transistor, M41 is the forty first transistor, and M42 is the forty second transistor.

In specific implementation, M13 and M43 can be symmetrically arranged on both sides of X axis X0, M14 and M44 can be symmetrically arranged on both sides of X axis X0, M15 and M41 can be symmetrically arranged on both sides of X axis X0, M16 and M42 can be symmetrically arranged on both sides of the X axis X0, but not limited.

At least one embodiment of the present disclosure provides a high-resolution 8 k AMOLED pixel structure using top gate process and top emission technology, which includes two design schemes of GOA at the output end of the gate driving signal.

The display panel according to at least one embodiment of the present disclosure includes the above-mentioned display substrate.

The display device according to at least one embodiment of the present disclosure includes the above-mentioned display panel.

The display device provided in at least one embodiment of the present disclosure may be any product or component with a display function such as a mobile phone, a tablet computer, a television, a display, a notebook computer, a digital photo frame, a navigator, and the like.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A gate driving unit, comprising an Nth stage of shift register unit and an (N+1)th stage of shift register unit, wherein N is a positive integer;

the Nth stage of shift register unit comprises an Nth stage of pull-up node control circuit, and the (N+1)th stage of shift register unit comprises an (N+1)th stage of pull-up node control circuit;

the Nth stage of pull-up node control circuit is electrically connected to an Nth stage of pull-up node and a control line, respectively, is configured to control a potential of the Nth stage of pull-up node under the control of a control signal inputted by the control line; and the (N+1)th stage of pull-up node control circuit is electrically connected to an (N+1)th stage of pull-up node and the control line, respectively, and is configured to control a potential of the (N+1)th stage of pull-up node under the control of the control signal inputted by the control line, wherein the control line comprises a first pull-up control line and a reset signal line;

the Nth stage of pull-up node control circuit is configured to control a potential of the Nth stage of pull-up node under the control of a first pull-up control signal provided by the first pull-up control line and a reset signal provided by the reset signal line; and the (N+1)th stage of pull-up node control circuit is configured to control a potential of the (N+1)th stage of pull-up node under the control of the first pull-up control signal and the reset signal, wherein the Nth stage of pull-up node control circuit comprises an Nth stage of first control circuit, an Nth stage of second control circuit, and an Nth stage of third control circuit;

the Nth stage of first control circuit is electrically connected to the reset signal line, the Nth stage of control node, a first voltage terminal, and the Nth stage of pull-up node, respectively, and is configured to control the connection among the Nth stage of pull-up node, the Nth stage of control node and the first voltage terminal under the control of the reset signal provided by the reset signal line;

the Nth stage of second control circuit is electrically connected to the first pull-up control line, the Nth stage of control node, the first voltage terminal and the Nth stage of pull-up node, respectively, is configured to control the connection among the Nth stage of pull-up node, the Nth stage of control node and the first voltage terminal under the control of the first pull-up control signal provided by the first pull-up control line;

the Nth stage of third control circuit is electrically connected to the Nth stage of control node and the Nth stage of pull-up node, respectively;

the (N+1)th stage of pull-up node control circuit comprises an (N+1)th stage of first control circuit, an (N+1)th stage of second control circuit, and an (N+1)th stage of third control circuit;

the (N+1)th stage of first control circuit is electrically connected to the reset signal line, an (N+1)th stage of control node, the first voltage terminal and an (N+1)th stage of pull-up node, respectively, is configured to control the connection among the (N+1)th stage of pull-up node, the (N+1)th stage of control node and the first voltage terminal under the control of the reset signal provided by the reset signal line;

the (N+1)th stage of second control circuit is electrically connected to the first pull-up control line, the (N+1)th stage of control node, the first voltage terminal, and the (N+1)th stage of pull-up node, respectively, and is configured to control the connection among the (N+1)th stage of pull-up node, the (N+1)th stage of control node and the first voltage terminal under the control of the first pull-up control signal provided by the first pull-up control line;

the (N+1)th stage of third control circuit is electrically connected to the (N+1)th stage of control node and the (N+1)th stage of pull-up node, respectively, the Nth stage of first control circuit comprises a first control transistor and a second control transistor, the (N+1)th stage of first control circuit comprises a third control transistor and a fourth control transistor; the Nth stage of second control circuit comprises a fifth control transistor and a sixth control transistor, the (N+1)th stage of second control circuit comprises a seventh control transistor and an eighth control transistor; the Nth stage of third control circuit comprises a ninth control transistor and a tenth control transistor, the (N+1)th stage of third control circuit comprises an eleventh control transistor and a twelfth control transistor;

the first control transistor and the third control transistor are arranged symmetrically on both sides of an X axis;

the second control transistor and the fourth control transistor are arranged symmetrically on both sides of the X axis;

the fifth control transistor and the seventh control transistor are arranged symmetrically on both sides of the X axis;

the sixth control transistor and the eighth control transistor are symmetrically arranged on both sides of the X axis;

the ninth control transistor and the eleventh control transistor are symmetrically arranged on both sides of the X axis; and the tenth control transistor and the twelfth control transistor are symmetrically arranged on both sides of the X axis.

2. The gate driving unit according to claim 1, wherein the Nth stage of first control circuit comprises a first control transistor and a second control transistor, a control electrode of the first control transistor is electrically connected to the reset signal line, a first electrode of the first control transistor is electrically connected to the Nth stage of pull-up node, and a second electrode of the first control transistor is electrically connected to the Nth stage of control node;

a control electrode of the second control transistor is electrically connected to the reset signal line, a first electrode of the second control transistor is electrically connected to the Nth stage of control node, and a second electrode of the second control transistor is electrically connected to the first voltage terminal;

the (N+1)th stage of first control circuit comprises a third control transistor and a fourth control transistor, a control electrode of the third control transistor is electrically connected to the reset signal line, a first electrode of the third control transistor is electrically connected to the (N+1)th stage of pull-up node, and a second electrode of the third control transistor is electrically connected to the (N+1)th stage of control node; and a control electrode of the fourth control transistor is electrically connected to the reset signal line, a first electrode of the fourth control transistor is electrically connected to the (N+1)th stage of control node, and a second electrode of the fourth control transistor is electrically connected to the first voltage terminal.

3. The gate driving unit according to claim 1, wherein the Nth stage of the second control circuit comprises a fifth control transistor and a sixth control transistor;

a control electrode of the fifth control transistor is electrically connected to the first pull-up control line, a first electrode of the fifth control transistor is electrically connected to the Nth stage of pull-up node, and a second electrode of the fifth control transistor is electrically connected to the Nth stage of control node;

a control electrode of the sixth control transistor is electrically connected to the first pull-up control line, a first electrode of the sixth control transistor is electrically connected to the Nth stage of control node, and the second electrode of the sixth control transistor is electrically connected to the first voltage terminal;

the (N+1)th stage of second control circuit comprises a seventh control transistor and an eighth control transistor, a control electrode of the seventh control transistor is electrically connected to the first pull-up control line, a first electrode of the seventh control transistor is electrically connected to the (N+1)th stage of pull-up node, and a second electrode of the seventh control transistor is electrically connected to the (N+1)th stage of control node; and a control electrode of the eighth control transistor is electrically connected to the first pull-up control line, a first electrode of the eighth control transistor is electrically connected to the (N+1)th stage of control node, and a second electrode of the eighth control transistor is electrically connected to the first voltage terminal.

4. The gate driving unit according to claim 1, wherein the Nth stage of pull-up node control circuit further comprises an Nth stage of pull-up control node control circuit, an Nth stage of fourth control circuit, and an Nth stage of fifth control circuit, the Nth stage of pull-up control node control circuit is respectively connected to an enable terminal, a second pull-up control line, the first node, a second voltage terminal and the Nth stage of pull-up control node, is configured to control the potential of the first node under the control of an enable signal provided by the enable terminal, based on the potential of the second pull-up control line and the second voltage;

the Nth stage of fourth control circuit is electrically connected to the first clock signal terminal, the Nth stage of pull-up control node, the Nth stage of control node and the second voltage terminal, respectively, and is configured to control the connection between the Nth stage of pull-up control node and the Nth stage of pull-up node under the control of a first clock signal, and control the connection between the Nth stage of control node and the second voltage terminal under the control the potential of the Nth stage of the pull-up node; and the Nth stage of fifth control circuit is electrically connected to the first pull-down node, the second pull-down node, the Nth stage of pull-up node, the Nth stage of control node and the first voltage terminal, respectively, and is configured to control the connection between the Nth stage of pull-up node and the Nth stage of control node and the connection between the Nth stage of control node and the first voltage terminal under the control of the potential of the first pull-down node, and is configured to control the connection between the Nth stage of pull-up node and the Nth stage of control node and the connection between the Nth stage of control node and the first voltage terminal under the control of the potential of the second pull-down node.

5. The gate driving unit according to claim 4, wherein the Nth stage of pull-up control node control circuit comprises:

a first transistor, a control electrode thereof being electrically connected to the enable terminal, and a first electrode thereof being electrically connected to the second pull-up control line;

a second transistor, a control electrode thereof being electrically connected to the enable terminal, and a first electrode thereof being electrically connected to the second electrode of the first transistor;

a third transistor, a control electrode thereof being electrically connected to the first node, a first electrode thereof being electrically connected to the second electrode of the first transistor, and a second electrode thereof being electrically connected to the second voltage terminal;

a first capacitor, a first end thereof being electrically connected to the first node; and a fourth transistor, a control electrode thereof being electrically connected to the first node and a second electrode thereof being electrically connected to the Nth stage of pull-up control node.

6. The gate driving unit according to claim 4, wherein the Nth stage of fourth control circuit comprises a fifth transistor and a tenth transistor, a control electrode of the fifth transistor is electrically connected to the first clock signal terminal and a first electrode of the fifth transistor is electrically connected to the Nth stage of pull-up control node; and a control electrode of the tenth transistor is electrically connected to the Nth stage of pull-up node, a first electrode of the tenth transistor is electrically connected to the Nth stage of control node, and a second electrode of the tenth transistor is electrically connected to the second voltage terminal.

7. The gate driving unit according to claim 4, wherein the Nth stage of fifth control circuit comprises:

a thirteenth transistor, a control electrode thereof being electrically connected to the first pull-down node, a first electrode thereof being electrically connected to the Nth stage of pull-up node, and a second electrode thereof being electrically connected to the Nth stage of control node;

a fourteenth transistor, a control electrode thereof being electrically connected to the first pull-down node, a first electrode thereof being electrically connected to the Nth stage of control node, and a second electrode thereof being is electrically connected to the first voltage terminal;

a fifteenth transistor, a control electrode thereof being electrically connected to the second pull-down node, a first electrode thereof being electrically connected to the Nth stage of pull-up node, and a second electrode thereof being is electrically connected to the Nth stage of control node; and a sixteenth transistor, a control electrode thereof being is electrically connected to the second pull-down node, a first electrode thereof being electrically connected to the Nth stage of control node, and a second electrode thereof being is electrically connected to the first voltage terminal.

8. The gate driving unit according to claim 4, wherein the (N+1)th stage of pull-up node control circuit further comprises an (N+1)th stage of fourth control circuit and an (N+1)th stage of fifth control circuit;

the (N+1)th stage of fourth control circuit is connected to the first clock signal terminal, the Nth stage of pull-up control node and the second voltage terminal, under the control of the first clock signal, controls the connection between the Nth stage of pull-up control node and the (N+1)th stage of pull-up node, and under the control of the potential of (N+1)th stage of pull-up node, controls the connection between the (N+1)th stage of control node and the second voltage terminal; and the (N+1)th stage of fifth control circuit is respectively connected to the first pull-down node, the second pull-down node, the (N+1)th stage of pull-up node, and the (N+1)th stage of control node and the first voltage terminal, and the under the control of the potential of the first pull-down node, controls the connection between the (N+1)th stage of pull-up node and the (N+1)th stage of control node, and controls the connection between the (N+1)th stage of control node and the first voltage terminal, and under the control of the potential of the second pull-down node, controls the connection between the (N+1)th stage of pull-up node and the (N+1)th stage of control node, and the connection between the (N+1)th stage of control node and the first voltage terminal.

9. The gate driving unit according to claim 8, wherein the (N+1)th stage of fourth control circuit comprises a thirty third transistor and a thirty eighth transistor;

a control electrode of the thirty third transistor is electrically connected to the first clock signal terminal, a first electrode of the thirty third transistor is electrically connected to the Nth stage of pull-up control node; and a control electrode of the thirty eighth transistor is electrically connected to the (N+1)th stage of pull-up node, a first electrode of the thirty eighth transistor is electrically connected to the (N+1)th stage of control node, and a second electrode of the thirty eighth transistor is electrically connected to the second voltage terminal.

10. The gate driving unit according to claim 9, wherein the (N+1)th stage of fifth control circuit comprises:

a forty first transistor, a control electrode thereof being electrically connected to the first pull-down node, a first electrode thereof being electrically connected to the (N+1)th stage of pull-up node, and a second electrode thereof being electrically connected to the (N+1)th stage of control node;

a forty second transistor, a control electrode thereof being electrically connected to the first pull-down node, a first electrode thereof being electrically connected to the (N+1)th stage of control node, and a second electrode thereof being electrically connected to the first voltage terminal;

a forty third transistor, a control electrode thereof being electrically connected to the second pull-down node, a first electrode thereof being electrically connected to the (N+1)th stage of pull-up node, and a second electrode thereof being electrically connected to the (N+1)th stage of control node; and a forty fourth transistor, a control electrode thereof being electrically connected to the second pull-down node, a first electrode thereof being electrically connected to the (N+1)th stage of control node, and a second electrode thereof being is electrically connected to the first voltage terminal.

11. A gate driving circuit comprising a plurality of gate driving units according to claim 1.

12. A display substrate comprising a base substrate and the gate driving circuit according to claim 11 arranged on the base substrate.

13. The display substrate according to claim 12, wherein the X axis is parallel to a gate line between the Nth stage of shift register unit included in the gate driving unit and the (N+1)th stage of shift register unit included in the gate driving unit.

14. The display substrate according to claim 12, wherein there is an X axis parallel to the gate line between of the Nth stage of shift register unit included in the gate driving unit and the (N+1)th stage of shift register unit included in the gate driving unit;

the Nth stage of pull-up node control circuit comprises an Nth stage of pull-up control node control circuit, an Nth stage of fourth control circuit, and an Nth stage of fifth control circuit; the (N+1)th stage of pull-up node control circuit comprises (N+1)th stage of fourth control circuit and (N+1)th stage of fifth control circuit;

the Nth stage of fifth control circuit comprises a thirteenth transistor, a fourteenth transistor, a fifteenth transistor, and a sixteenth transistor, and the (N+1)th stage of fifth control circuit comprises a forty first transistor, a forty second transistor, a forty third transistor and a forty fourth transistor; and the thirteenth transistor and the forty third transistor are symmetrically arranged on both sides of the X axis, the fourteenth transistor and the forty fourth transistor are symmetrically arranged on both sides of the X axis, and the fifteenth transistor and the forty first transistor are symmetrically arranged on both sides of the X axis, and the sixteenth transistor and the forty second transistor are symmetrically arranged on both sides of the X axis.

15. A display panel comprising the display substrate according to claim 12.

16. A display device comprising the display panel according to claim 15.

* * * * *